US008166673B2

(12) United States Patent
Sills

(10) Patent No.: US 8,166,673 B2
(45) Date of Patent: May 1, 2012

(54) AIR BLADDER FOOTBED

(75) Inventor: Craig K. Sills, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 475 days.

(21) Appl. No.: 12/501,400

(22) Filed: Jul. 10, 2009

(65) Prior Publication Data

US 2011/0005101 A1 Jan. 13, 2011

(51) Int. Cl.
*A43B 13/20* (2006.01)

(52) U.S. Cl. ..... 36/29; 36/35 B

(58) Field of Classification Search ..... 36/29, 35 B, 36/153, 154, 28, 30 R
See application file for complete search history.

(56) References Cited

U.S. PATENT DOCUMENTS

| | | | | |
|---|---|---|---|---|
| 4,342,158 | A | 8/1982 | McMahon et al. | |
| 4,918,838 | A * | 4/1990 | Chang | 36/28 |
| 5,086,574 | A * | 2/1992 | Bacchiocchi | 36/35 R |
| 5,685,090 | A | 11/1997 | Tawney et al. | |
| 5,718,063 | A | 2/1998 | Yamashita et al. | |
| 5,766,704 | A | 6/1998 | Allen et al. | |
| 5,815,950 | A | 10/1998 | Wang | |
| 5,894,683 | A | 4/1999 | Lin | |
| 5,894,687 | A | 4/1999 | Lin | |
| 5,933,983 | A * | 8/1999 | Jeon | 36/29 |
| 5,939,157 | A | 8/1999 | Allen et al. | |
| 5,955,159 | A | 9/1999 | Allen et al. | |
| 5,985,383 | A | 11/1999 | Allen et al. | |
| 6,115,944 | A | 9/2000 | Lain | |
| 6,176,025 | B1 * | 1/2001 | Patterson et al. | 36/28 |
| 6,711,836 | B2 | 3/2004 | Weiss | |
| 6,796,056 | B2 | 9/2004 | Swigart | |
| 7,073,276 | B2 * | 7/2006 | Swigart | 36/29 |
| 7,200,955 | B2 * | 4/2007 | Foxen | 36/25 R |
| 7,243,443 | B2 | 7/2007 | Swigart | |
| 7,426,792 | B2 * | 9/2008 | Swigart et al. | 36/28 |
| 7,559,158 | B2 | 7/2009 | Rosendahl | |
| 7,946,060 | B2 * | 5/2011 | Rosenbaum | 36/30 R |
| 2003/0208930 | A1 | 11/2003 | Swigart | |
| 2004/0216330 | A1 | 11/2004 | Swigart | |
| 2005/0268490 | A1 * | 12/2005 | Foxen | 36/28 |
| 2005/0278978 | A1 | 12/2005 | Swigart | |
| 2006/0021251 | A1 | 2/2006 | Swigart et al. | |
| 2007/0089319 | A1 | 4/2007 | Liao et al. | |
| 2007/0294832 | A1 | 12/2007 | Shiao | |
| 2011/0126423 | A1 * | 6/2011 | Yang | 36/29 |

FOREIGN PATENT DOCUMENTS

| | | |
|---|---|---|
| DE | 3805604 | 9/1989 |

* cited by examiner

*Primary Examiner* — Ted Kavanaugh
(74) *Attorney, Agent, or Firm* — Plumsea Law Group, LLC

(57) ABSTRACT

A sole system for an article of footwear comprising: an outsole layer and an insole layer, each of which include a vertically extending opening, a midsole layer disposed between the outsole and insole layers and including a bottom surface, a top surface, and an opening that extends vertically through the midsole layer to define a cavity therein, the cavity opening having a first dimension at the bottom surface substantially corresponding to the outsole layer opening and a second dimension at the top surface substantially corresponding to the insole layer opening; and a bladder element having a top and a base, wherein a portion of the bladder element is secured within the midsole cavity such that the top extends into at least a portion of the insole layer opening and the base extends into the outsole layer opening, wherein the bladder element and the midsole cavity include corresponding shapes and dimensions.

41 Claims, 21 Drawing Sheets

AIR BLADDER FOOTBED

BACKGROUND

The present invention relates generally to an article of footwear, and in particular to an article of footwear with an air bladder.

Articles of footwear with bladders or other similar structures that are located in the heel area of a shoe have been proposed. These bladders are typically positioned in one or more cavities found in the midsole and/or insole of a shoe and are often used in combination with a cushioning element. Some of these known bladder elements may be transparent. For example, Tawney et al. (U.S. Pat. No. 5,685,090) is directed to a cushioning system for a shoe sole that includes an inflatable air bladder in the heel of a shoe that is positioned in a cavity in the midsole. An upper with a lasting sock covers the air bladder, both of which may be transparent. An opening may be formed in the outsole layer so that the bladder element is visible from the bottom of the shoe. Likewise, Allen et al. (U.S. Pat. No. 5,985,383) is directed to a foam footbed that includes a viscoelastic polymer plug in the heel area of a shoe. The plug is embedded in and generally surrounded by a non-woven textile layer which, in turn, is positioned within a foam layer of the shoe midsole. The textile layer extends horizontally in an upper part of the footbed and then vertically downward into the midsole in the heel area of the shoe. A layer, such as leather, covers the horizontal portions of the non-woven textile layer, leaving the top portion of the plug exposed. A gel bladder and window may be positioned in the bottom layer beneath the heel plug.

SUMMARY

The invention discloses an air bladder element for a sole system of an article of footwear. In one aspect, the invention provides a sole system for an article of footwear, comprising: an outsole layer for contacting the surface of the ground, the outsole layer having a predetermined thickness and including an opening extending vertically through the layer; an insole layer having a predetermined thickness and including an opening extending vertically through the layer; a midsole layer disposed between the outsole layer and the insole layer, the midsole layer having a predetermined thickness and including a bottom surface and a top surface, the midsole layer further including an opening that extends vertically through the midsole layer and which defines a cavity therein, the cavity opening having a first dimension at the bottom surface which substantially corresponds to the opening in the outsole layer and a second dimension at the top surface which substantially corresponds to the opening in the insole layer; and a bladder element having a top and a base, wherein a portion of the bladder element is secured within the midsole cavity such that the top extends into at least a portion of the opening in the insole layer and the base extends into at least a portion of the opening in the outsole layer, wherein the bladder element and the midsole cavity include corresponding shapes and dimensions.

In another aspect, the invention provides an article of footwear comprising: an outsole layer for contacting the surface of the ground, the outsole layer having a predetermined thickness and including an opening extending vertically through the layer; an insole layer having a predetermined thickness and including an opening extending vertically through the layer; a midsole layer disposed between the outsole layer and the insole layer, the midsole layer having a predetermined thickness and including a bottom surface and a top surface, the midsole layer further including an opening that extends vertically through the midsole layer and which defines a cavity therein, the cavity opening having a first dimension at the bottom surface which substantially corresponds to the opening in the outsole layer and a second dimension at the top surface which substantially corresponds to the opening in the insole layer; a bladder element having a top and a base, wherein a portion of the bladder element is secured within the midsole cavity such that the top extends into at least a portion of the opening in the insole layer and the base extends into at least a portion of the opening in the outsole layer, wherein the bladder element and the midsole cavity include corresponding shapes and dimensions; wherein the first and second dimensions of the midsole cavity opening are defined by a lower and upper peripheral edge, respectively, with the opening in the adjacent outsole layer including an upper peripheral edge and the opening in the adjacent insole layer including a lower peripheral edge; wherein the peripheral edges in adjacent layers have substantially the same configuration and dimensions, with the peripheral edges curving inwardly along a vertical axis and a horizontal axis and being flush with the top of the bladder element; and wherein the layers are horizontal such that each includes a longitudinal axis that is aligned with the length of the shoe, the horizontal layers having substantially corresponding surfaces and being disposed on each other in a vertically stacked configuration, wherein the vertical openings and peripheral edges in adjacent layers are aligned with one another and substantially conform to and are flush with an arcuate portion of the bladder element.

In another aspect, the invention provides a sole system for an article of footwear comprising: an outsole layer for contacting the surface of the ground, the outsole layer having a predetermined thickness and including an opening that extends vertically through the layer and which is defined by a lower and upper peripheral edge; an insole layer having a predetermined thickness and including an opening that extends vertically through the layer and which is defined by a lower and upper peripheral edge; a midsole layer disposed between the outsole layer and the insole layer, the midsole layer having a predetermined thickness and including an opening that extends vertically through the midsole layer and which defines a cavity therein, the cavity having an inner arcuate surface that is concave, with the cavity opening being defined by a first peripheral edge and a second peripheral edge, wherein the peripheral edges in adjacent layers have substantially the same configuration and dimension; a bladder element having a convex top with an outer arcuate surface and a flat base, wherein a portion of the outer arcuate surface is secured within the midsole cavity such that the convex top extends into at least a portion of the vertical opening in the insole layer and the flat base extends into at least a portion of the vertical opening in the outsole layer, wherein the outer arcuate surface of the bladder element is flush with and has substantially the same shape and dimensions as the inner arcuate surface of the midsole cavity; a clear sheet that is positioned within the opening in the outsole layer and which covers at least the base while still providing visibility of the bladder element; wherein the layers are horizontal such that each includes a longitudinal axis that is aligned with the length of the shoe, the horizontal layers having substantially corresponding surfaces and being disposed on one another in a vertically stacked configuration such that the vertical openings in adjacent layers are aligned with one another; and wherein the peripheral edges in adjacent layers have substantially the same configuration and dimensions, wherein the peripheral edges curve inwardly along a vertical axis and a horizontal axis and are flush with the outer arcuate surface of the bladder element.

Other systems, methods, features and advantages of the invention will be, or will become apparent to one with skill in the art upon examination of the following figures and detailed description. It is intended that all such additional systems, methods, features and advantages be included within this description, be within the scope of this invention, and be protected by the following claims.

BRIEF DESCRIPTION OF THE DRAWINGS

The invention may be better understood with references to the following figures and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
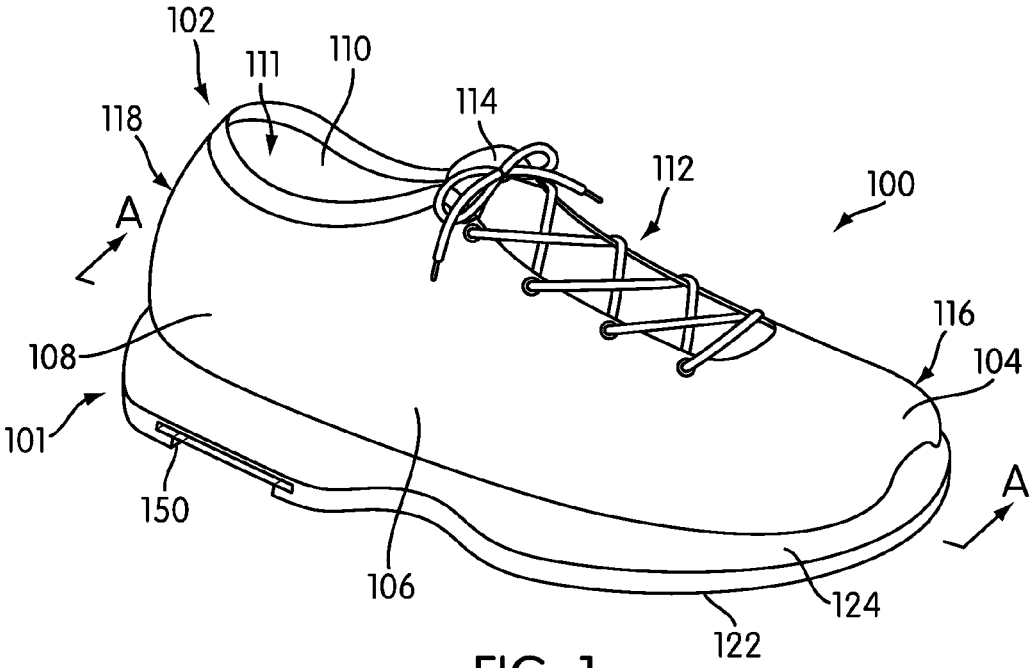
FIG. 1 is an isometric view of a preferred embodiment of an article of footwear.

FIG. 1 is an isometric view of a preferred embodiment of an article of footwear 100. In a preferred embodiment, article of footwear 100 may be a running shoe. For clarity, the following detailed description discusses a preferred embodiment. However, it should be kept in mind that the present invention could also take the form of any other kind of footwear including, for example, any type of athletic shoes, boots, as well as other kinds of footwear. As shown throughout the figures, article of footwear 100 is intended to be used with a right foot. However, it should be understood that the following discussion may equally apply to a mirror image of article of footwear 100 that is intended for use with a left foot.

Figure 2:
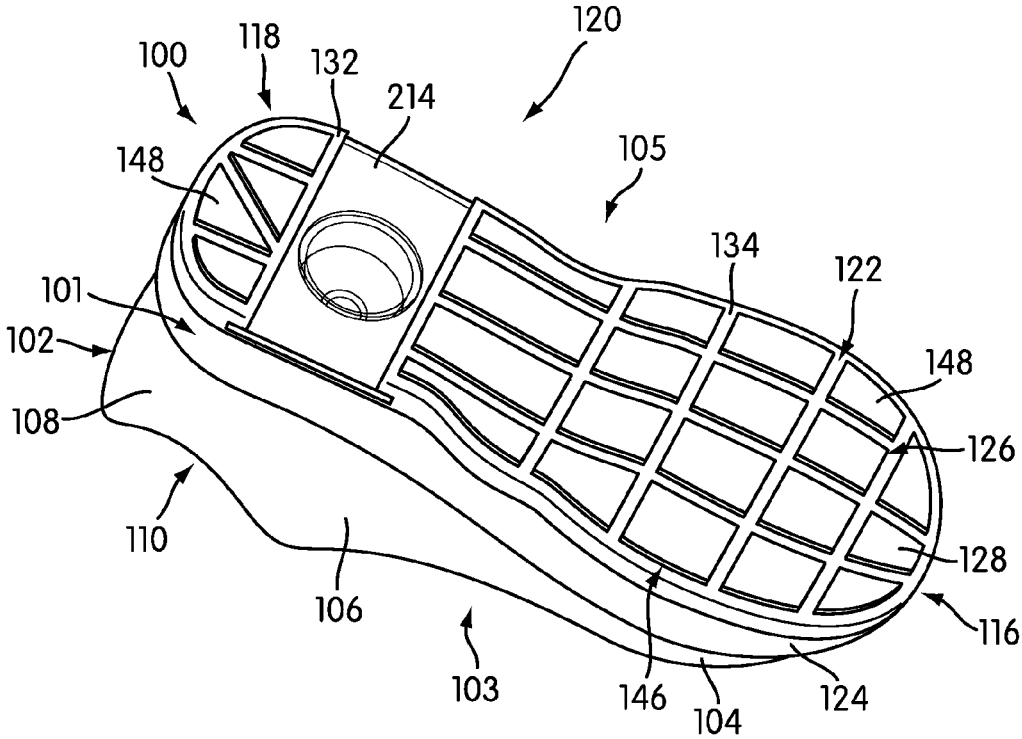
FIG. 2 is an upside down view of a preferred embodiment of an article of footwear.

Referring to FIGS. 1-2, article of footwear 100 generally includes a sole system 101 and an upper 102. For reference purposes, footwear 100 includes a lateral side 103 and a medial side 105 and may be divided into three general regions: a forefoot region 104, a midfoot region 106, and a heel region 108, as shown in FIGS. 1-2. Forefoot region 104 generally includes portions of footwear 100 corresponding with the toes and the joints connecting the metatarsals with the phalanges. Midfoot region 106 generally includes portions of footwear 100 corresponding with the arch area of the foot, and heel region 108 corresponds with rear portions of the foot, including the calcaneus bone. Lateral side 103 and medial side 105 extend through each of regions 104, 106, 108 and correspond with opposite sides of footwear 100. Regions 104, 106, 108 and sides 103, 105 are intended to represent general areas of footwear 100 to aid in the following discussion. In addition to footwear 100, regions 104, 106, 108 and sides 103, 105 may also be applied to sole system 101, upper 102, and individual elements thereof.

Referring to FIGS. 1-2, upper 102 defines a void 111 within footwear 100 for receiving and securing a foot relative to sole system 101. The void is shaped to accommodate the foot and extends along the lateral side of the foot, along the medial side of the foot, over the foot, around the heel, and under the foot. Access to void 111 is provided by an ankle opening 110 located in at least heel region 108. Upper 102 may include a fastening system 112. In this embodiment, fastening system 112 is a pair of laces which extend through various apertures and permits the wearer to modify dimensions of upper 102 to accommodate the proportions of the foot. More particularly, lace 112 permits the wearer to tighten upper 102 around the foot, and lace 112 permits the wearer to loosen upper 102 to facilitate entry and removal of the foot from void 111 (i.e., through ankle opening 110). However, in other embodiments, a different fastening system may be used such as straps, zippers or other types of fastening systems. In addition, upper 102 may include a tongue 114 that extends under lace 112. The various portions of upper 102 may be formed from one or more of a plurality of material elements (e.g., textiles, polymer sheets, foam layers, leather, synthetic leather) that are stitched or bonded together to form void 111 within footwear 100.

Figure 3:
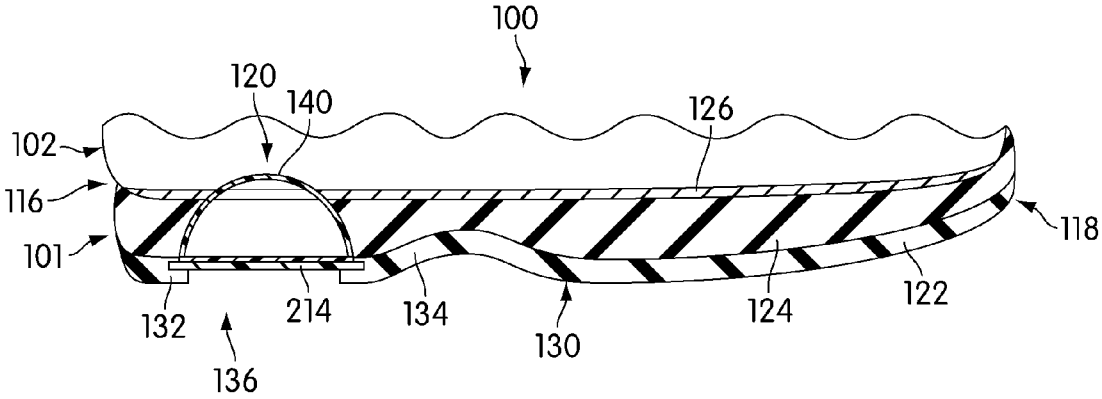
FIG. 3 is a partial cross-sectional view of a preferred embodiment of a sole system, taken along lines A-A of FIG. 1.

Sole system 101 of article of footwear 100 is secured to upper 102. Sole system 101 extends between the foot and the ground when footwear 100 is worn and longitudinally from a distal end 116 to a proximal end 118 of footwear 100 (FIGS. 1-4). Sole system 101 may comprise a single layer of material (not depicted in Figures) or may comprise a layer system 121 which includes, but is not limited to, an outsole layer 122, a midsole layer 124, and a sockliner or insole layer 126 (FIGS. 3, 5). Midsole layer 124 is secured to a lower surface of upper 102 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. Outsole layer 122 is secured to a lower surface of midsole layer 124 and may be formed from a wear-resistant rubber material that is textured to impart traction. Insole 126 is located within upper 102 and is positioned to extend under a lower surface of the foot. In other embodiments of the sole system, as referenced by numeral 201 and to which all of the foregoing is similarly applicable, layer system, as referenced by numeral 221, may include a strobel layer 128 which is secured between the insole and midsole layers (see FIGS. 4, 6). In further configurations, the single layer (not depicted in figures) or layer systems 121, 221 may also include provisions for providing additional cushioning to article of footwear 100. One such provision is shown in the Figures, and is directed to an air bladder 120 which extends through the entire vertical height of the sole system. It should be understood that the figures illustrate an exemplary embodiment of air bladder 120 and that various sizes and shapes of air bladder 120 may be used within sole system 101. Moreover, the layer or layers comprising sole systems 101, 201 may vary in height or thickness. In the embodiments that include layer system 121 or 221, midsole layer 124 generally includes the greatest height or thickness of the sole system layers.

Figure 4:
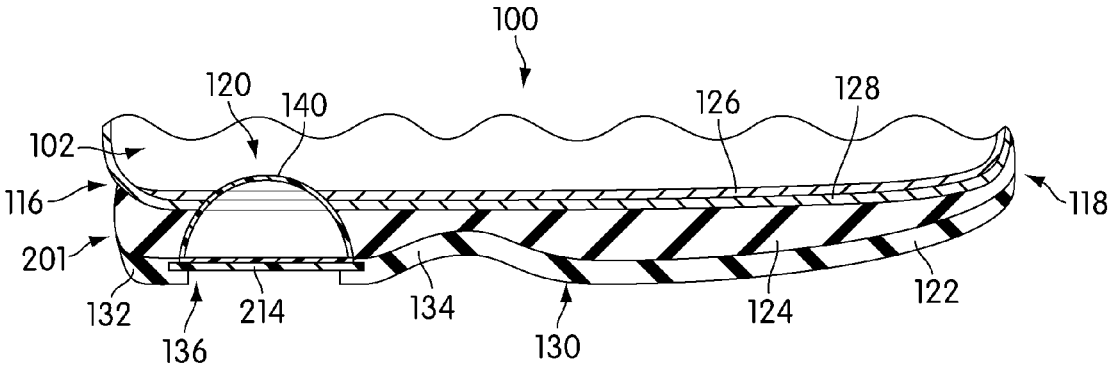
FIG. 4 is a partial cross-sectional view of another preferred embodiment of a sole system.
Figure 5:
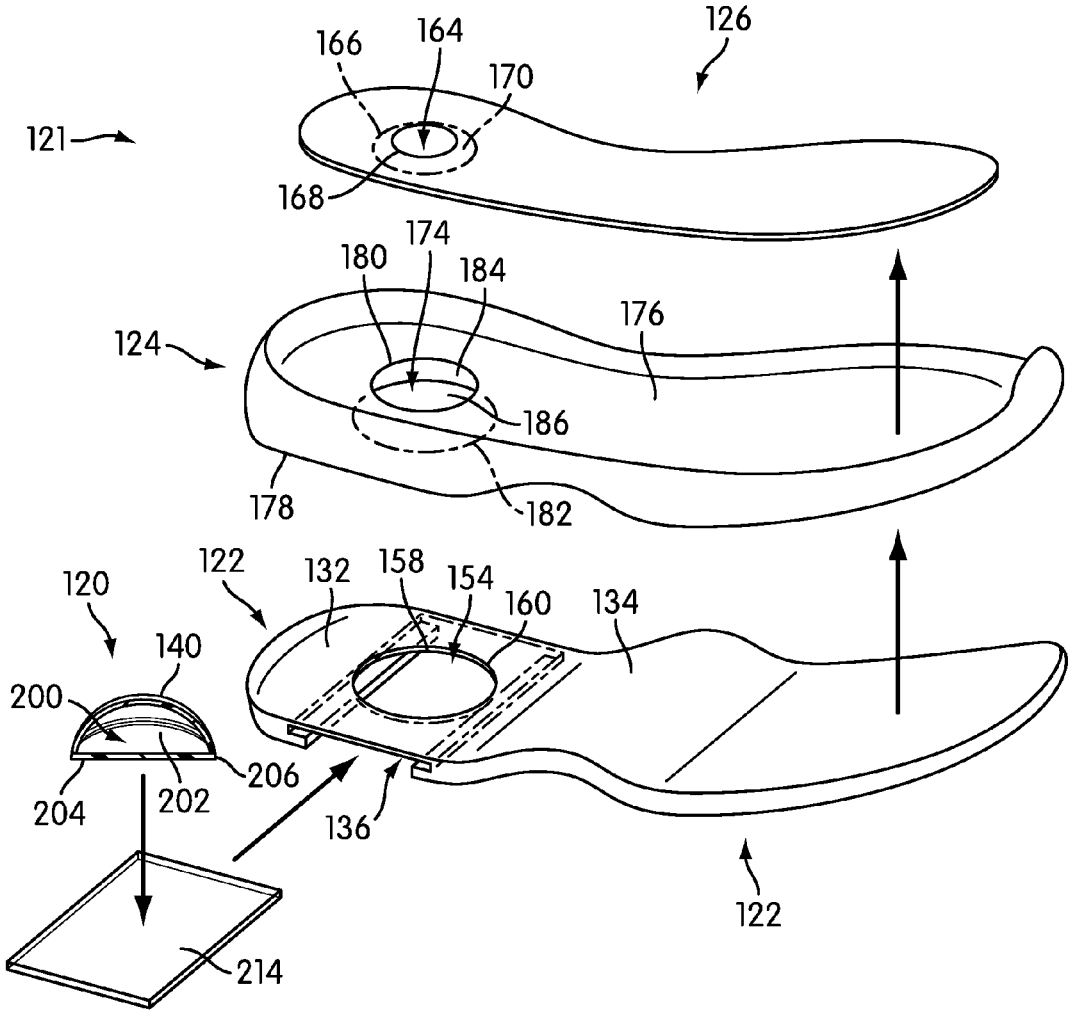
FIG. 5 is an exploded isometric view of a preferred embodiment of a sole system.
Figure 6:
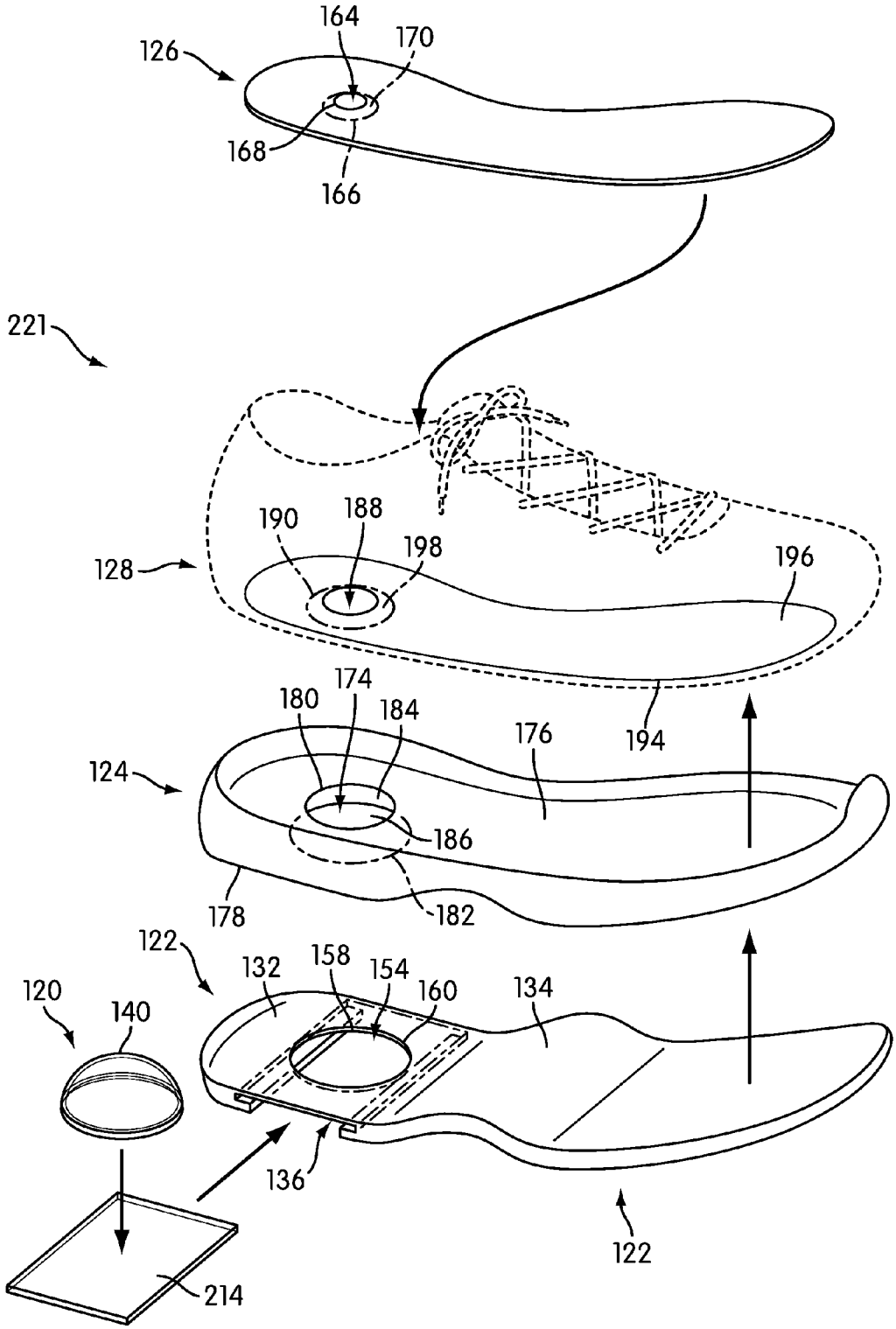
FIG. 6 is an exploded isometric view of another preferred embodiment of a sole system.

Referring to the embodiments of FIGS. 3-4, the various layers of layer systems 121, 221 (or in instances of a single layer) generally may extend horizontally from distal end 116 to proximal end 118 of article of footwear 100 such that each layer includes a longitudinal axis that is aligned with the length of article of footwear 100. The layers have generally contoured upper and lower surfaces and may be disposed flush with one another in a vertically stacked configuration where outsole layer 122 is generally the ground contacting layer and insole layer 126 is generally the layer adjacent to upper 102. In one preferred embodiment of layer system 121, midsole layer 124 may be disposed between outsole layer 122 and insole layer 126. In one preferred embodiment of layer system 221, strobel layer 128 may be disposed between midsole layer 124 and insole layer 126. As shown in the embodiment of FIGS. 5-6, the various layers of layer systems 121, 221 may include openings which extend vertically through the height of the layers and which conform to the shape and dimensions of air bladder 120, as will be discussed in greater detail hereinafter.

Figure 8:
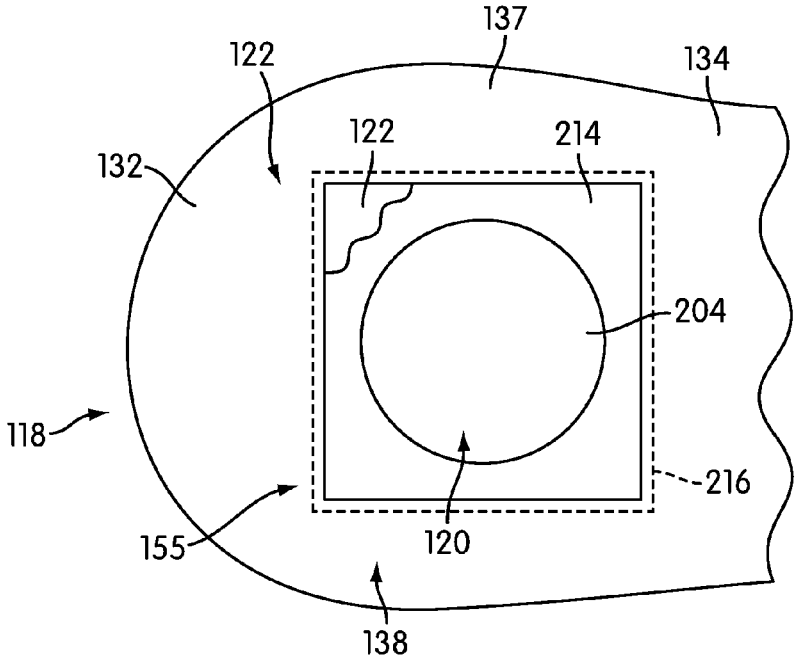
FIG. 8 is a partial bottom plan view of another embodiment of an air bladder cover.

Referring to FIGS. 3-4, outsole layer 122 may be disposed on a bottom side 130 of article of footwear 100, generally extending from distal end 116 to proximal end 118. Referring to the FIGS. 2 and 5-6, in some embodiments, outsole layer 122 may be partially discontinuous in the lower part of the outsole or the part which is in closest proximity to treaded portion 146 and may include a first outsole section 132 and a second outsole section 134 which together define the lower part of a vertically extending opening 136 in the outsole layer. First outsole section 132 of outsole layer 122 may be disposed adjacent to proximal end 118 and second outsole section 134 of outsole layer 122 may extend from an area near proximal end 118 to distal end 116. While the partially discontinuous outsole sections generally define the lower part of outsole layer 122, the upper part of the outsole layer or the part which is in closest proximity to midsole layer 124 may be continuous and includes the upper part of opening 136 (FIGS. 5-6). In other embodiments (FIG. 8), outsole layer 122 is continuous on both its upper and lower part and may include peripheral outsole portions 137, 138 which are integrally formed with first outsole section 132 and second outsole section 134. An opening may then be defined, in various configurations, by the first and second outsole sections, 132 and 134, respectively, along with peripheral outsole portions 137, 138 (FIG. 8). In additional embodiments, outsole layer 122 may be discontinuous throughout its entire vertical height (not depicted in the Figures).

In other embodiments, outsole layer 122 may additionally be configured to conform to the contour of a toe portion 142 and/or a rear heel portion 144 of upper 102 adjacent distal end 116 and proximal end 118, respectively (not depicted in the Figures).

Figure 11:
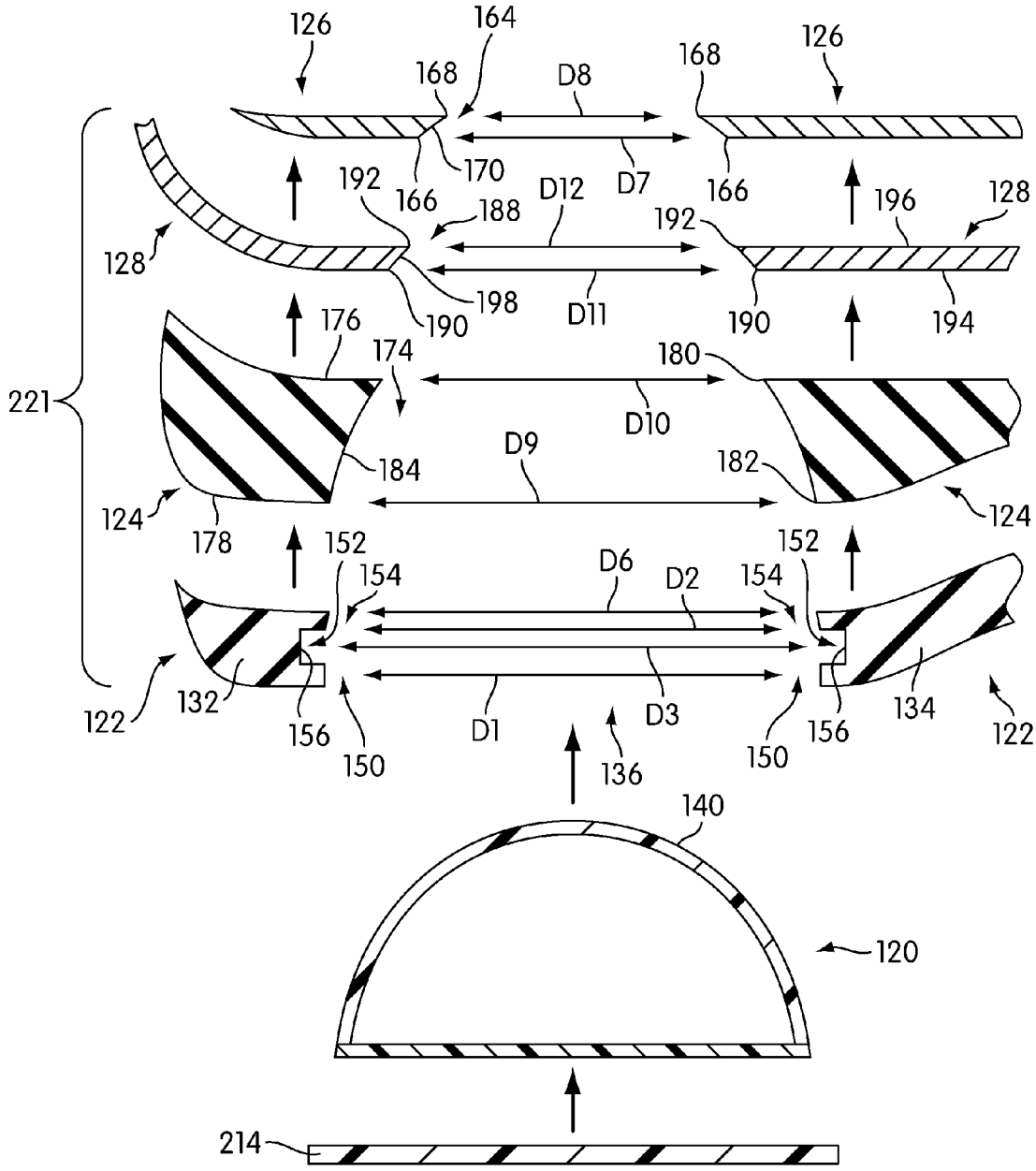
FIG. 11 is a partial exploded schematic cross-sectional view of another preferred embodiment of a sole system.
Figure 12:
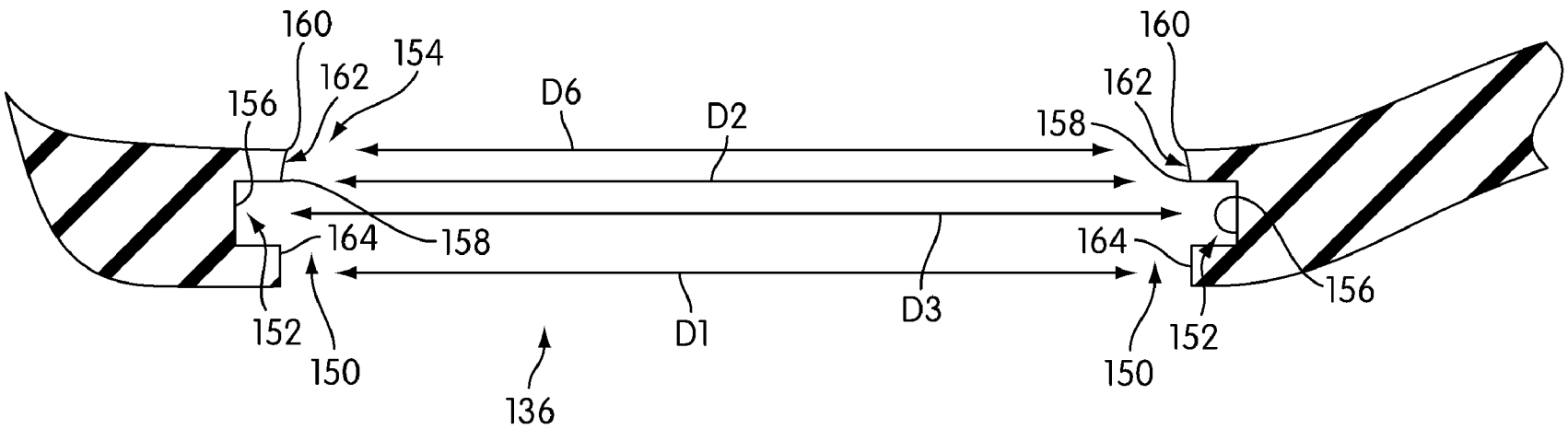
FIG. 12 is an enlarged partial schematic cross-sectional view of a preferred embodiment of the outsole of a shoe.

Outsole layer 122 may be made of varying height or thickness, as needed. As previously mentioned, an opening 136 may be disposed on bottom surface 130 of outsole layer 122 and may extend vertically through the height or thickness of outsole layer 122. In one preferred embodiment, opening 136 of outsole layer 122 may include an outer portion 150, a middle portion 152 and an inner portion 154 in which the outer and inner portions generally define a peripheral recess 156 within middle portion 152 (see FIGS. 10-13). In this embodiment, outer portion 150 of opening 136 may include a width or diameter D1 (depending on the configuration of the opening) which is substantially the same as an outermost diameter D2 of inner portion 154 but which generally may be smaller than a width or diameter D3 of middle portion 152 (FIG. 12). In other preferred embodiments and referring to FIGS. 14A-14C, opening 136 may include an outer portion 150 having a width or diameter D4 and an inner portion 154 having a diameter D5, where width or diameter D4 of outer portion 150 is generally larger than diameter D5 of inner portion 154. In contrast, in another preferred embodiment and shown in FIG. 14D, opening 136 may include an outer portion 150 having a width or diameter D13 and an inner portion 154 having a diameter D14, in which the width or diameter D13 of outer portion 154 is generally smaller than the diameter D14 of inner portion 154. Both diameters D4 and D5 (FIGS. 14A-14C) and diameters D13 and D14 (FIG. 14D) generally define a stepped configuration, in part, inside opening 136. In some of these embodiments, the vertical height of outer portion 150, as defined by opening 136, may vary and will be described in greater detail hereinafter. Likewise, in any of the preferred embodiments, the vertical height of middle and/or inner portions, 152 and 154, respectively, may also vary according to need.

In addition to outermost diameter D2, inner portion 154 in any of the preferred embodiments may include an innermost diameter D6. Outermost diameter D2 and innermost diameter D6 are defined by a lower peripheral edge 158 and an upper peripheral edge 160, respectively (see FIG. 12). Inner portion 154 may also include an inner peripheral surface 162 which is the part of inner portion 154 between the peripheral edges. Thus, outermost diameter D2 of opening 136 on inner portion 154, as defined by lower peripheral edge 158, may generally be larger than innermost diameter D6 of opening 136, as defined by upper peripheral edge 160. This difference in the dimensions of diameters D2 and D6 within inner portion 154 generally may be attributed to the inward curving of the peripheral edges and inner peripheral surface 162 along a vertical axis. In addition, peripheral edges 158, 160 and inner peripheral surface 162 of outsole layer opening 136 preferably curve inwardly along a horizontal axis. The inward curving of the surfaces of inner portion 154, along both a vertical and horizontal axis, allows the entire vertical height or thickness of inner portion 154, as defined by inner peripheral surface 162, to be flush with a portion of air bladder 120, as will be discussed in greater detail below (see FIG. 13).

Figure 7:
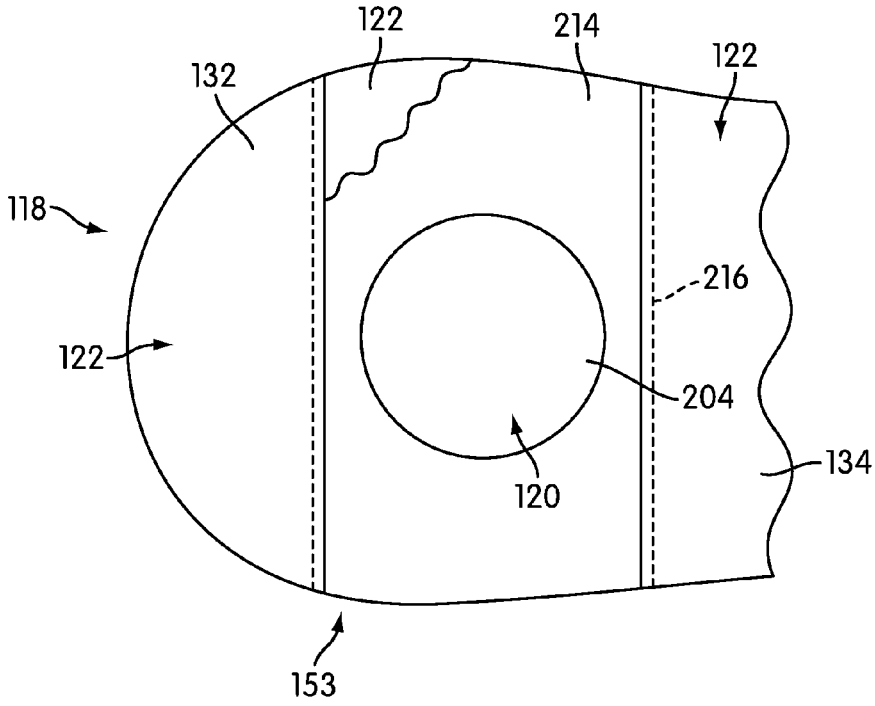
FIG. 7 is a partial bottom plan view of a preferred embodiment of an air bladder cover.
Figure 22:
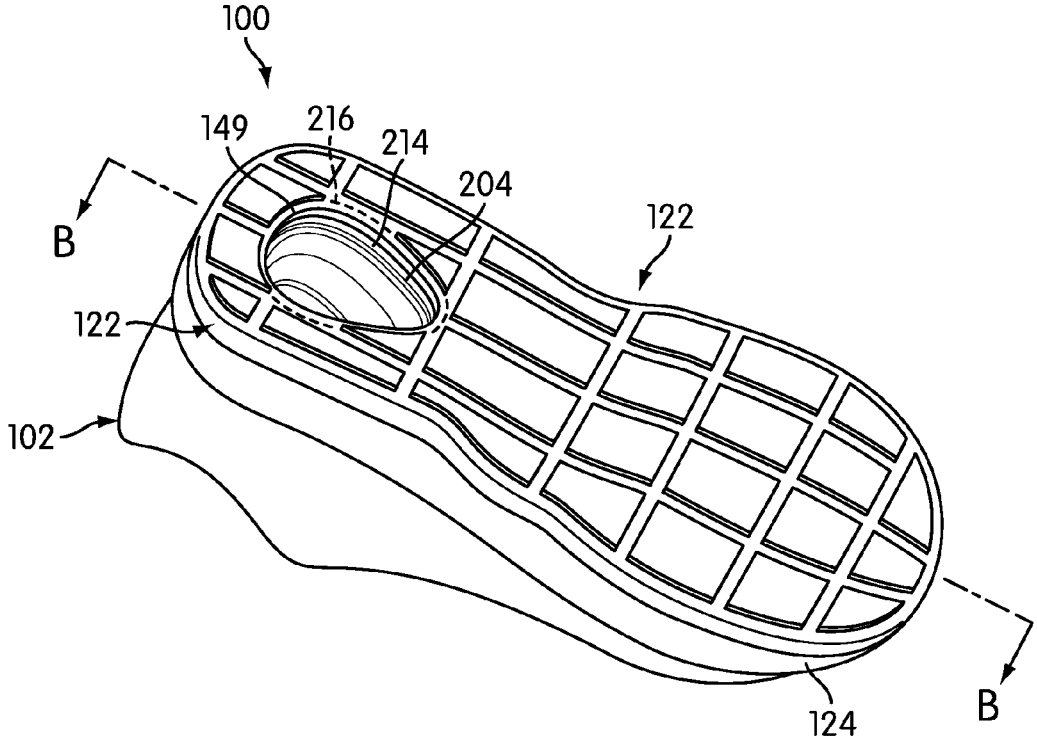
FIG. 22 is an upside down view of another preferred embodiment of an article of footwear.

In contrast to the inward curving of inner peripheral surface 162 of inner portion 154, outer portion 150 may include an inner peripheral surface 164 that is straight or uniform in diameter. Likewise, the inner peripheral surface of peripheral recess 156 of middle portion 152 may also be straight or uniform in diameter. Moreover, in the instance of a non-discontinuous outsole layer 122, portions 150, 152 and/or 154 of outsole layer 122 may be configured in any number of shapes, including but not limited to, a pear shape 149 (FIG. 22), a circular shape 151 (FIG. 18), or a square shape 155 (FIG. 8). In the instance of a discontinuous outsole layer 122, as defined by peripheral outsole portions 137, 138, outer portion 150 and/or middle portion 152 may be configured in a rectangular shape 153 (FIGS. 5-7).

In some embodiments, additional traction may be achieved between article of footwear 100 and the ground using a treaded portion 146. In a preferred embodiment, treaded portion 146 includes a plurality of tread elements 148 which may comprise any geometric shape. Tread elements 148 may additionally be disposed on peripheral outsole portions 137, 138, as well as toe portion 142, rear heel portion 144 and bottom side 130 of article of footwear 100. Treaded portion 146 preferably provides the proper amount of traction between article of footwear 100 and the ground, as required by the user of article of footwear 100.

Generally, outsole layer 122 may be made from any suitable material. Examples of suitable materials include, but are not limited to, elastomers, siloxanes, natural rubber, other synthetic rubbers, aluminum, steel, natural leather, synthetic leather, or plastics. In a preferred embodiment, outsole layer 122 may be made of rubber.

Figure 10:
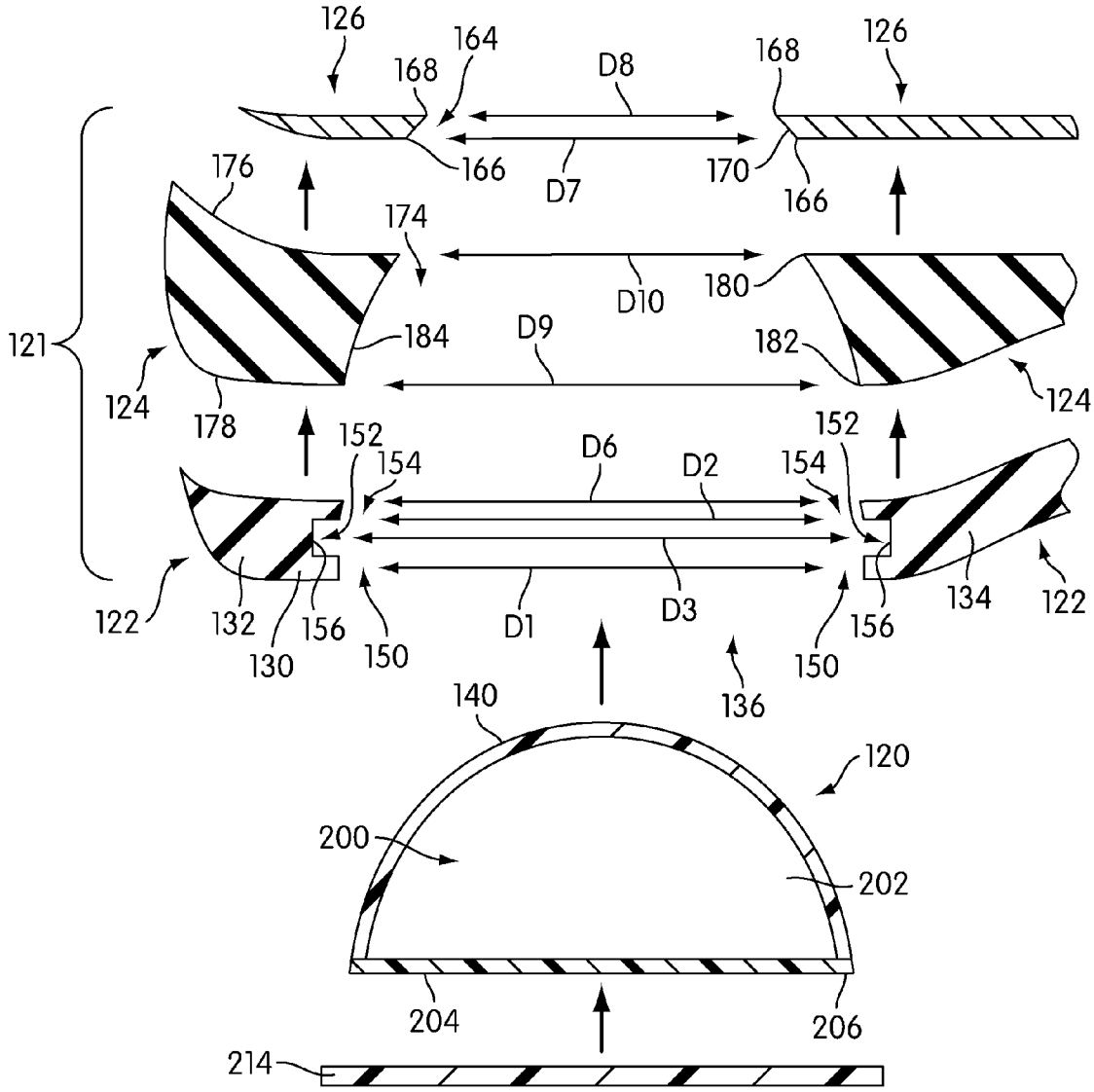
FIG. 10 is a partial exploded schematic cross-sectional view of a preferred embodiment of a sole system.
Figure 13:
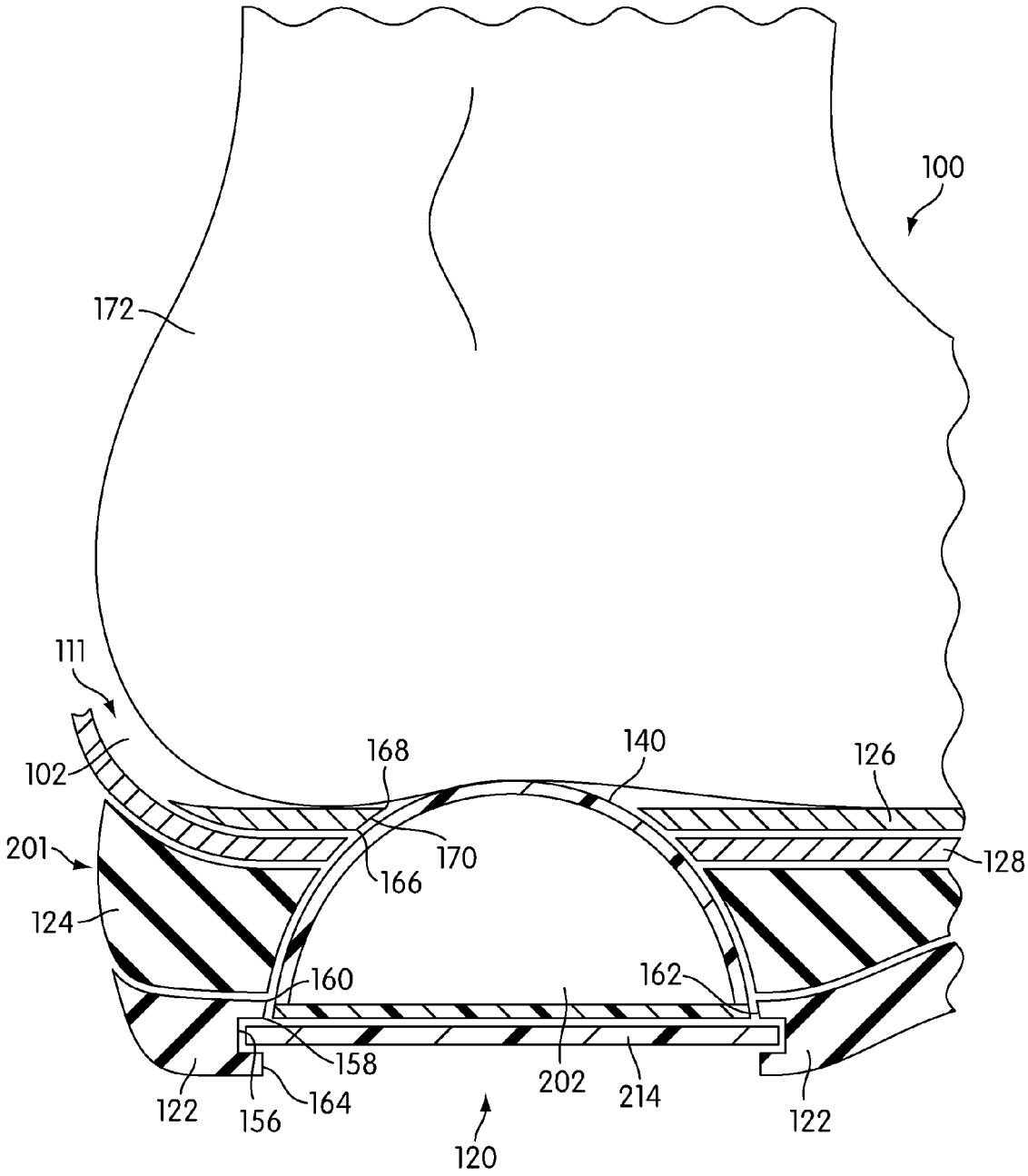
FIG. 13 is a partial cross-sectional view of a preferred embodiment of a sole system.
Figure 14A:
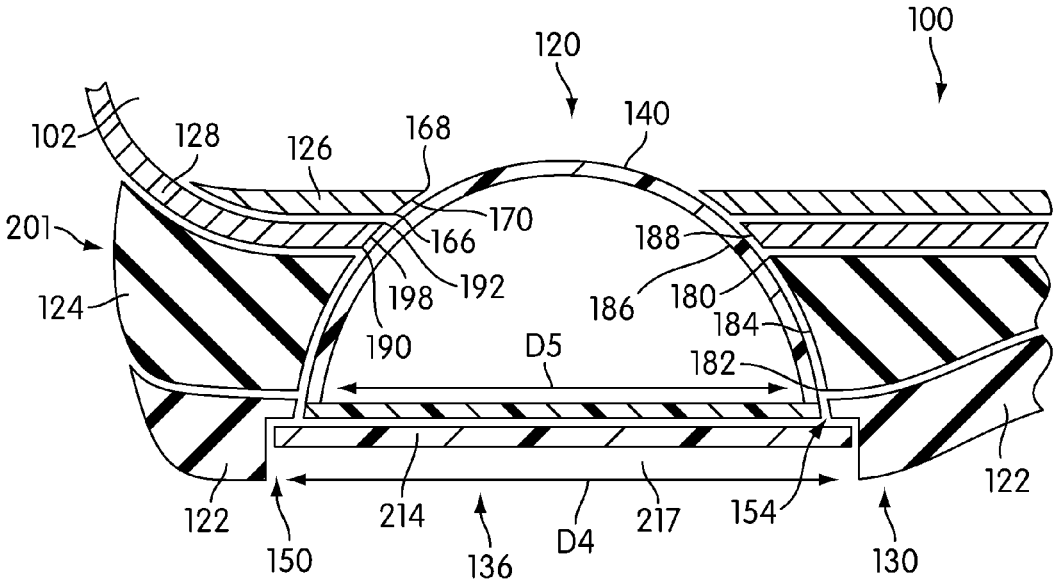
FIG. 14A is a partial cross-sectional view of another preferred embodiment of a sole system.
Figure 14B:
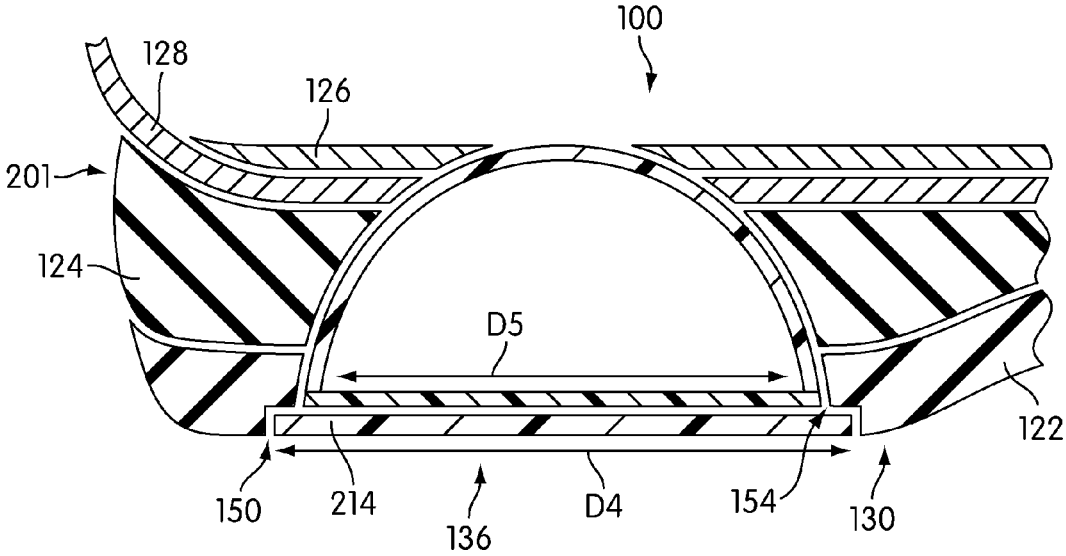
FIG. 14B is a partial cross-sectional view of another embodiment of a sole system.
Figure 16:
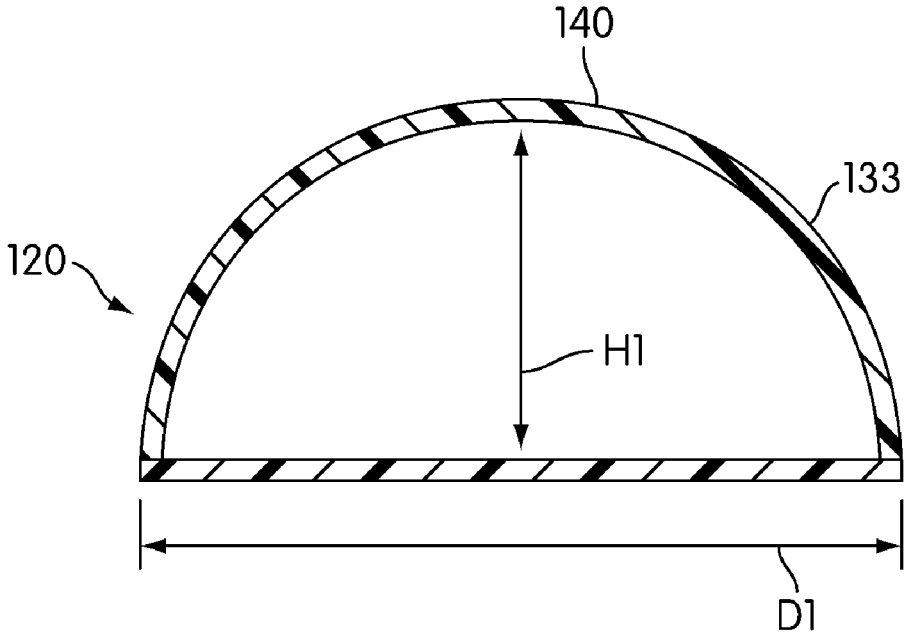
FIG. 16 is a cross-sectional view of another preferred embodiment of an air bladder.

Referring to FIGS. 3-6, insole layer 126 may also be made of varying height or thickness, as needed. Insole layer 126 may extend horizontally from distal end 116 to proximal end 118 and in parallel relation to outsole layer 122. Insole layer 126 is preferably the uppermost layer in sole systems 101, 201. As previously mentioned, an opening 164 may extend vertically through insole layer 126. Also shown in FIGS. 10-11, opening 164 may include a lower peripheral edge 166, an upper peripheral edge 168, and an inner peripheral surface 170. In one preferred embodiment, lower peripheral edge 166 may be adjacent to midsole layer 124, while upper peripheral edge 168 may be adjacent to an interior space as defined by opening 110 in upper 102 for receiving the foot of the wearer (FIG. 16). Lower peripheral edge 166 of insole layer opening 164 may include a diameter D7 which preferably may be smaller than a diameter D8 of upper peripheral edge 168 of outsole layer 122 (FIGS. 10-11). The difference in diameters D7 and D8 within insole layer 126 generally may be attributed to the inward curving of peripheral edges 166, 168 and inner peripheral surface 170 along a vertical axis. Additionally, peripheral edges 166, 168 and inner peripheral surface 170 of insole layer opening 164 also preferably curve inwardly along a horizontal axis. The inward curving of the surfaces of insole layer opening 164, along both a vertical and horizontal axis, allows the entire vertical height of insole layer opening 164, as defined by inner peripheral surface 170, to be flush with a portion of air bladder 120, which will be discussed in greater detail hereinafter (FIGS. 13-14A).

Generally, insole layer 126 may be made from any suitable material. Examples of suitable materials include, but are not limited to, plastic foams, rubber, or viscoelastic polymers, as well as other materials. In a preferred embodiment, insole layer 126 may be made of rubber.

Figure 18:
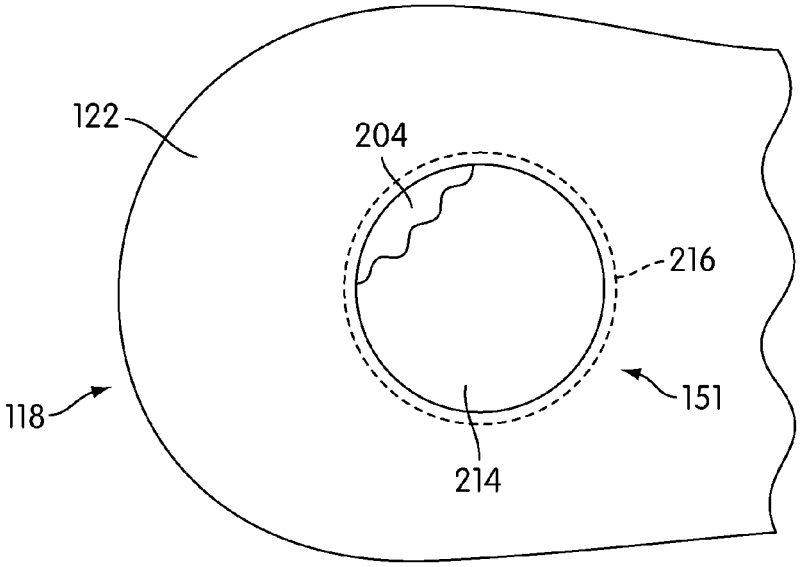
FIG. 18 is a partial bottom plan view of yet another embodiment of an air bladder cover.

Referring next to FIGS. 3-4, midsole layer 124 may be made of varying height or thickness, as needed. Midsole layer 124 may extend horizontally from distal end 116 to proximal end 118 in parallel relation to outsole layer 122 and insole layer 126. In one preferred embodiment, midsole layer 124 is positioned between insole layer 126 and outsole layer 122 (FIGS. 5, 10). As previously mentioned, an opening 174 may extend vertically through midsole layer 124 from an upper surface 176 to a lower surface 178, as defined by an upper peripheral edge 180 and a lower peripheral edge 182, respectively. In turn, midsole layer opening 174 may include an inner arcuate peripheral surface 184 which defines a concave cavity 186 therein (see FIGS. 5-6, 14A). Referring to the preferred embodiments of FIGS. 10-11, lower peripheral edge 182 may be adjacent to outsole layer 122, while upper peripheral edge 180 may be adjacent to either insole layer 126 (the preferred embodiment of FIG. 10) or to strobel layer 128 (the preferred embodiment of FIG. 11). Lower peripheral edge 182 of midsole layer opening 174 includes a diameter D9 which may be larger than a diameter D10 of upper peripheral edge 180 (FIGS. 10-11). The difference in diameters D9 and D10 within midsole layer 124 generally may be attributed to the inward curving of the peripheral edges and the inner peripheral surface along a vertical axis. In addition, peripheral edges 180, 182 and cavity 186 of midsole layer opening 174 curve inwardly along a horizontal axis (FIGS. 10-11, 18). The inward curving of the arcuate surfaces of cavity 186, along both a vertical and horizontal axis, allow the entire vertical height of cavity 186 to be flush with a portion of air bladder 120, which will be discussed in greater detail hereinafter.

Generally, midsole layer 124 may be made from any suitable material. Examples of suitable materials include, but are not limited to, rubber, elastic foams, thermoplastic polyurethane, polyurethane, ethyl-vinyl-acetate, phylon, as well as other materials. In a preferred embodiment, midsole layer 124 may be made polyurethane or thermoplastic polyurethane.

In another preferred embodiment, sole system 201 may include strobel layer 128 which also may be made of a varying height or thickness, as needed. As with the other layers in the sole system, strobel layer 128 may extend horizontally from distal end 116 to proximal end 118 and in parallel relation to outsole layer 122, insole layer 126, and midsole layer 124. In a preferred embodiment, strobel layer 128 may be positioned between midsole layer 124 and insole layer 126. As previously mentioned, an opening 188 may extend vertically through strobel layer 128, as defined by a lower peripheral edge 190 on an upper surface 194 and an upper peripheral edge 192 on a lower surface 196. Strobel layer opening 188 also may include an inner peripheral surface 198 (FIGS. 6, 17).

Figure 17:
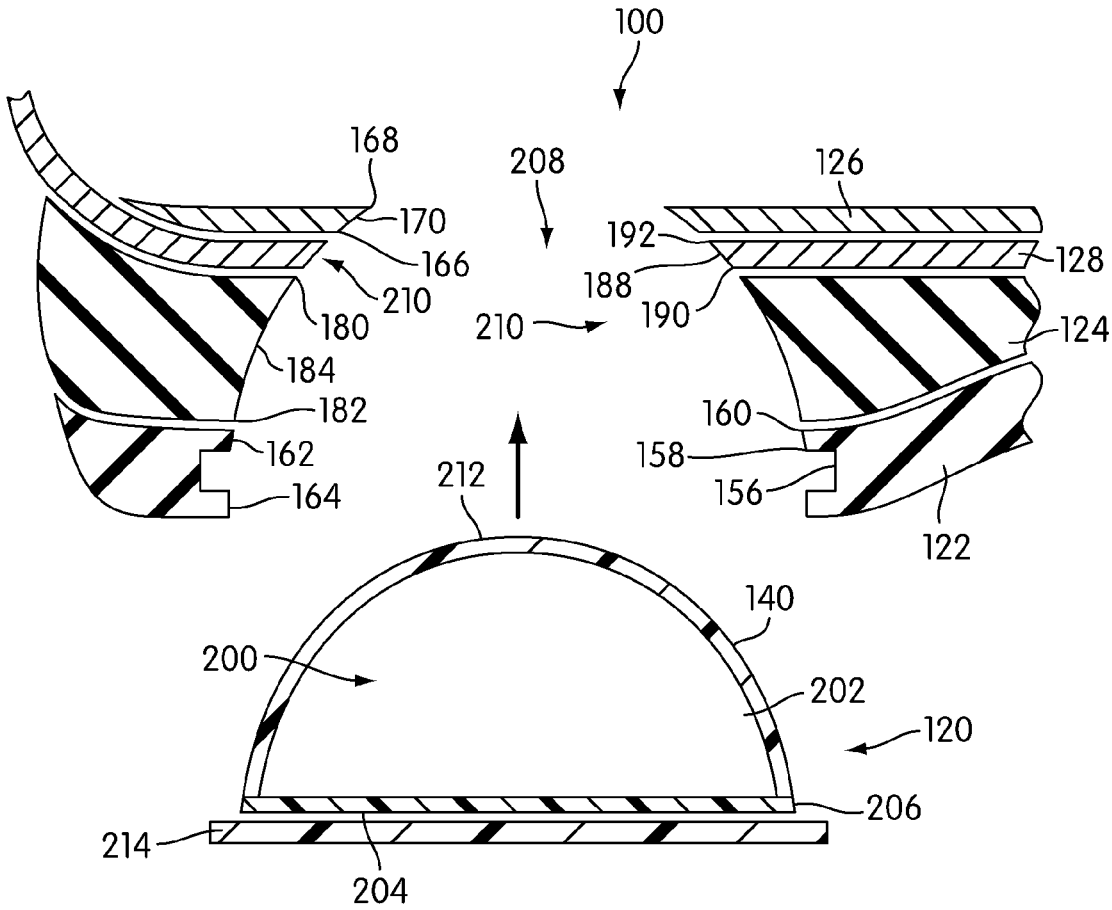
FIG. 17 is a partial schematic cross-sectional view of a preferred embodiment of a sole system, illustrating the insertion of an air bladder into a sole system.

Referring to the embodiment of FIG. 17, lower peripheral edge 190 may be adjacent to midsole layer 124, while upper peripheral edge 192 may be adjacent to insole layer 126. Lower peripheral edge 190 of strobel layer opening 188 includes a diameter D11 which may be larger than a diameter D12 of upper peripheral edge 192 (FIG. 11). The difference in diameters D11 and D12 within strobel layer 128 generally may be attributed to the inward curving of peripheral edges 190 and 192 and inner peripheral surface 198 along a vertical axis. In addition, peripheral edges 190 and 192 of strobel layer opening 188 preferably curve inwardly along a horizontal axis. It is the inward curving of the surfaces of strobel layer 128, along both a vertical and horizontal axis, which allow the entire vertical height of strobel layer opening 188, as defined by inner peripheral surface 198, to be flush with a portion of air bladder 120, which will be discussed in greater detail hereinafter (FIGS. 14A, 17).

Generally, strobel layer 128 may be made from any suitable material, including, but not limited to, any flexible woven material or a fabric board.

As shown in FIGS. 5-6 and 10-11, the peripheral edges and openings in adjacent horizontally extending and vertically stacked layers in sole systems 101, 201 preferably are aligned with one another and have substantially the same shape and dimensions. Thus, upper peripheral edge 160 of outsole layer opening 136 preferably has the same shape and dimensions as lower peripheral edge 182 of midsole layer opening 174. Likewise, upper peripheral edge 180 of midsole layer opening 174 preferably has substantially the same shape and dimensions as either lower peripheral edge 166 of insole layer opening 164, in one preferred embodiment, or lower peripheral edge 190 of strobel layer opening 188, in another preferred embodiment. In the preferred embodiments with strobel layer 128, upper peripheral edge 192 of strobel layer opening 188 preferably has substantially the same shape and dimensions as lower peripheral edge 166 of insole layer opening 164. As shown in FIGS. 10-11, in any of the preferred embodiments, the peripheral edges in adjacent sole layers not only align with one another but also may have substantially the same shape and dimensions. Moreover, the peripheral edges in adjacent sole layers preferably have substantially the same inward curve along both a vertical and horizontal axis.

Figure 26:
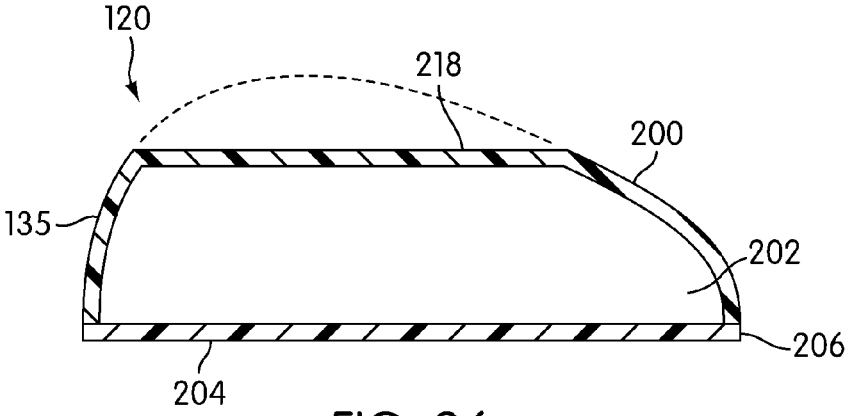
FIG. 26 is a cross-sectional view of a preferred embodiment of an air bladder, taken along lines C-C of FIG. 25.
Figure 27:
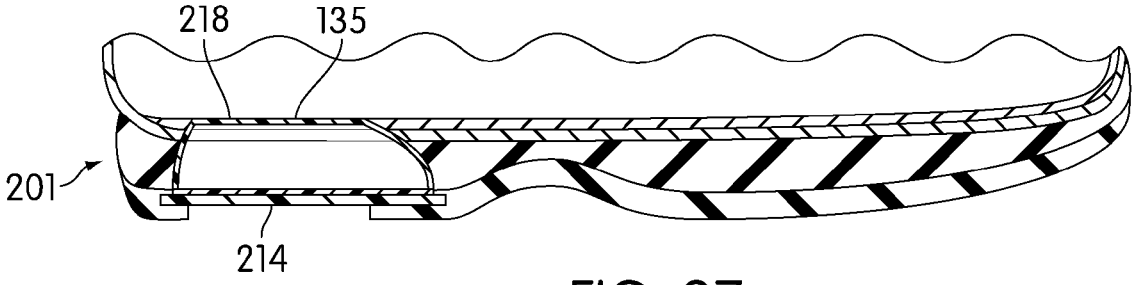
FIG. 27 is a partial cross-sectional view of another preferred embodiment of a sole system.
Figure 28:
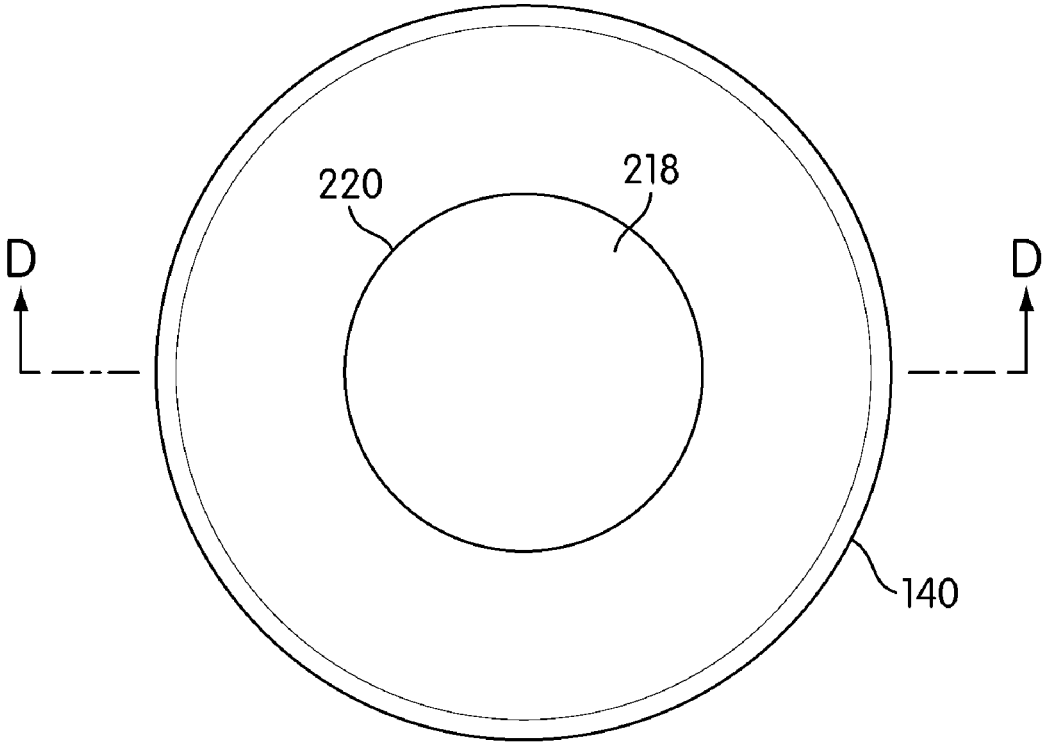
FIG. 28 is a plan view of another preferred embodiment of an air bladder.
Figure 29:
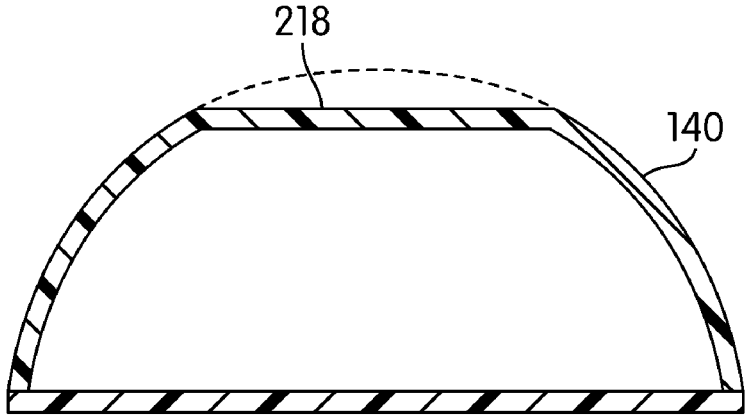
FIG. 29 is a cross-sectional view of another preferred embodiment of an air bladder, taken along lines D-D of FIG. 38.
Figure 30:
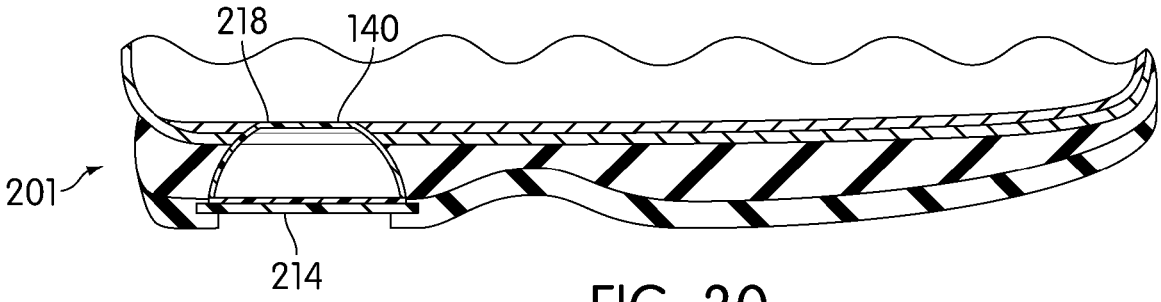
FIG. 30 is a partial cross-sectional view of yet another preferred embodiment of a sole system.

Referring to the Figures, air bladder 120 may be dome-shaped 140 (FIGS. 15-16), pear-shaped 135 (FIGS. 22-23), spherically shaped (not shown), or any other suitable geometric shape, and may include a generally convex top 200 and a substantially flat base 204 (see also FIGS. 5, 26). The dome-shaped air bladder 140 is preferably an oblate ellipsoid 131 (FIG. 15) or a hemisphere 133 (FIG. 16). All of the features that are disclosed in reference to the dome-shaped embodiments may also be applied to the pear-shaped embodiment. In any of the air bladder embodiments, convex top 200 may include an outer arcuate surface 202 which is attached to base 204 along a perimeter 206 of air bladder 120. Top 200 may be weld to base 204 along perimeter 206 to define a perimeter weld. Further details of the pear-shaped air bladder may be found in the following references: U.S. Pat. No. 6,796,056 to John Swigart, the entirety of which is incorporated herein by reference; U.S. Pat. No. 7,073,276 (divisional of U.S. Pat. No. 6,796,056) to John Swigart, the entirety of which is incorporated herein by reference; U.S. Pat. No. 7,243,443 (continuation of U.S. Pat. No. 7,073,276) to John Swigart, the entirety of which is incorporated herein by reference; and U.S. Pat. No. 7,426,792 to Bruce Kilgore and John Swigart, the entirety of which is incorporated herein by reference.

The shape of base 204 of air bladder 120 may be circular (FIGS. 7-8, 18), pear (FIG. 23), or in any other suitable geometric configuration. The shape and dimensions of base 204 substantially correspond with the shape and dimensions of inner portion 154 of outsole layer 122. Generally, the largest diameter (or width depending on the configuration of the air bladder) of air bladder 120 is at base 204 so that the diameter of air bladder 120 decreases from base 204 to the topmost portion 212 of top 200. Thus, the inward curving of outer arcuate surface 202, along both a vertical and horizontal axis, begins at base 204 and continues over the surface of the top of pear-shaped air bladder 135 and dome-shaped air bladders 131, 133 as they extend away from base 204 to topmost portion 212 of convex top 200. However, there may be embodiments in which the largest diameter or width of the air bladder is not at the base but may be found within the top of the bladder, as may be found in a generally spherical shaped air bladder or in some embodiments of the pear-shaped air bladder. However, in any of the aforementioned embodiments, the dimensions of the base, along with the dimensions and shape of the arcuate surface of the air bladder, generally correspond to the shape and dimensions of the layers that define the layer system in footwear 100.

Figure 15:
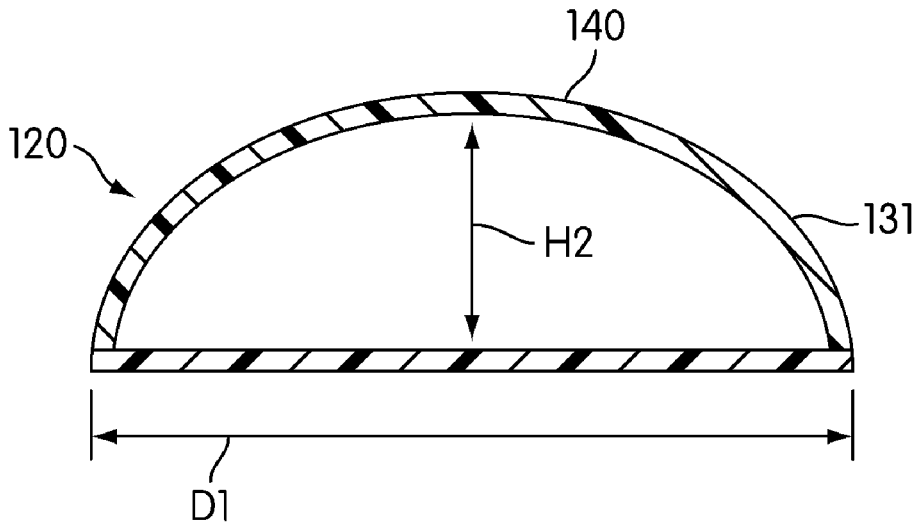
FIG. 15 is a cross-sectional view of a preferred embodiment of an air bladder.
Figure 24:
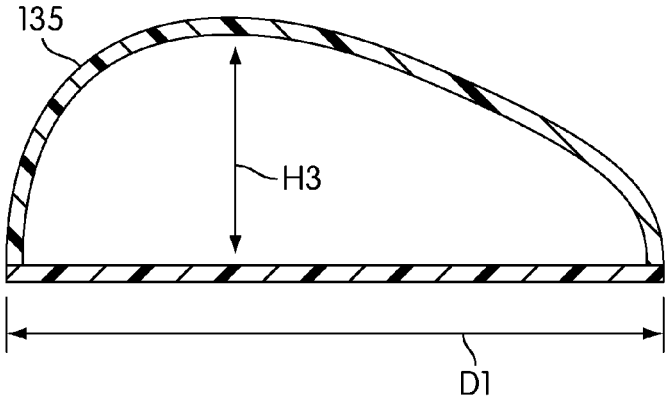
FIG. 24 is a cross-sectional view of yet another preferred embodiment of an air bladder.
Figure 25:
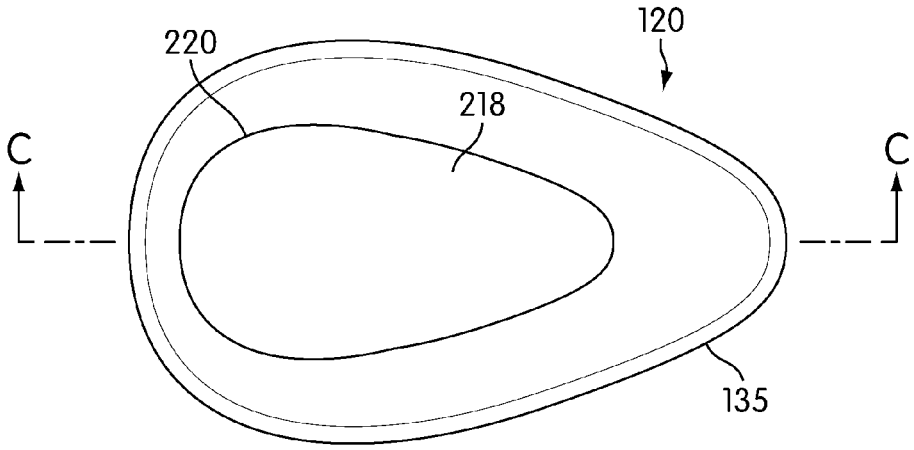
FIG. 25 is a top plan view of a preferred embodiment of an air bladder.

The diameters D1 (or widths depending on the base configurations) of the bases of the oblate ellipsoid, hemisphere, and pear-shape air bladders are substantially the same but the height H1 in the hemisphere may be greater than the height H2 of the oblate ellipsoid or the height H3 of the convex pear-shape (FIGS. 15-16, 24). However, in at least one embodiment, the height H1 in the hemisphere is substantially the same as the height H3 of the pear-shaped air bladder. Using one of the aforementioned air bladder shapes over the other, or any other similar suitable geometric shape, may depend on the vertical height needed in the sole system of article of footwear 100. Also, it should be understood that the aforementioned heights and diameters and/or widths are for illustrative purposes only and do not in any means serve to limit other possible height and/or diameter/width configurations that may be found in the air bladders.

As shown in FIGS. 25-29, top 200 may include a recess 218 for substantially conforming top 200 of the air bladder to the contours of a heel of the foot. Specifically, recess 218 is generally located on the topmost portion 212 of top 200 of pear-shaped air bladder 135 and dome-shaped air bladders 131, 133. Recess 218 may be shaped to substantially correspond to the shape of the air bladder base of the air bladder. For example, referring to the pear-shaped embodiments of FIGS. 25-26 and the dome-shaped embodiments of FIGS. 28-29, recess 218 may be generally configured in a pear-shape and in a circular shape, respectively. Alternatively, recess 218 may assume any other suitable geometric configuration. In addition, recess 218 may include a peripheral edge 220 which generally corresponds in size to peripheral edge 168 of insole layer 126. Thus, in those embodiments in which recess 218 is present, peripheral edge 168 of insole layer 126 is generally configured to correspond to both the shape and size of the recess in the air bladders. Accordingly, in pear-shaped air bladder 135, recess 218 and opening 164 of insole layer 126, as defined by peripheral edge 168, are preferably pear-shaped so that peripheral edges, 220 and 168, of recess 218 and opening 164, respectively, generally correspond in shape to one another and align along their peripheral edges. Likewise, in dome-shaped air bladders 131, 133, recess 218 and opening 164 of insole layer 126, as defined by peripheral edge 168, are preferably circular so that peripheral edges, 220 and 168, of recess 218 and opening 164, respectively, generally correspond in shape to one another and align along their peripheral edges.

In a preferred embodiment, air bladder 120 does not include any internal chambers but may include a single unobstructed enclosure that may be inflated with a gas. Air bladder 120 may be manufactured from any suitable molding process and is preferably made from a thermoplastic elastomer film, such as, polyester polyurethane, polyether polyurethane, as well as other similar materials. Air bladder 120 is preferably transparent.

The outer arcuate surface 202 of the pear-shaped air bladder 135 or the dome-shaped air bladder 131, 133 coincides, in shape and dimensions, with the inner arcuate curves of peripheral edges 180, 182 and inner arcuate surface 184 of midsole cavity 186 (see FIG. 14A). As previously mentioned, outsole layer 122, midsole layer 124, strobel layer 128, and insole layer 126 extend substantially horizontally and are disposed on one another in a vertically stacked configuration (FIGS. 11, 14A-14D). As a result of the horizontal layering and vertical stacking of the layers, the peripheral edges of the openings in each of the layers preferably are substantially aligned. Since the adjacent peripheral edges of the layers preferably have substantially the same inward curves, along both a vertical and horizontal axis, the vertically aligned openings in the horizontal layers form a large concave cavity 208 within sole systems 101, 201. Concave cavity 208 may include an arcuate surface 210 having substantially the same shape and dimensions of outer arcuate surface 202 of the dome-shaped air bladders or the pear-shaped air bladder. Thus, when an air bladder is positioned within cavity 208, the peripheral edges and inner arcuate surfaces of the openings of the layers substantially conform to and are flush with outer arcuate surface 202 of air bladder 120 (see FIGS. 13, 14A, 17).

Figure 14C:
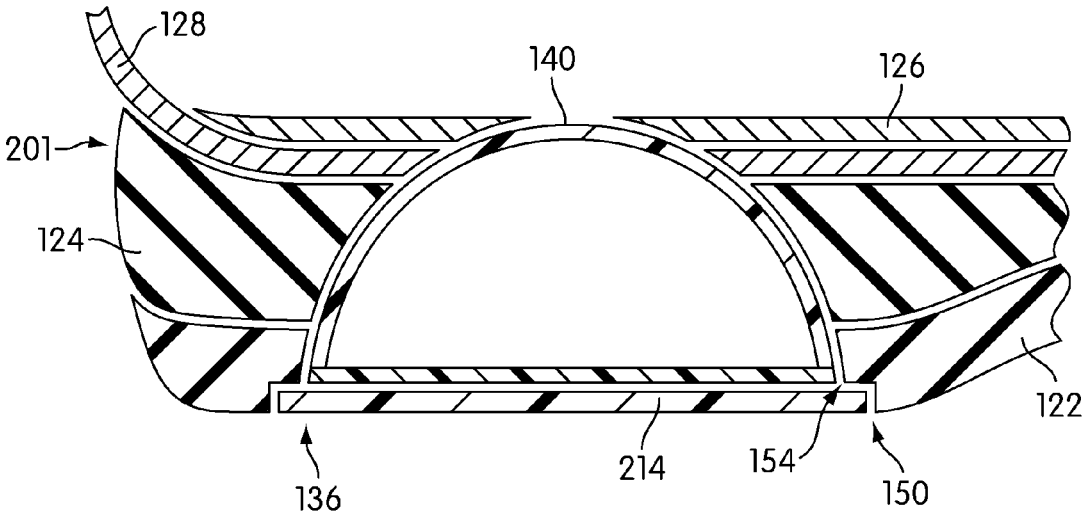
FIG. 14C is a partial cross-sectional view of another embodiment of a sole system.
Figure 14D:
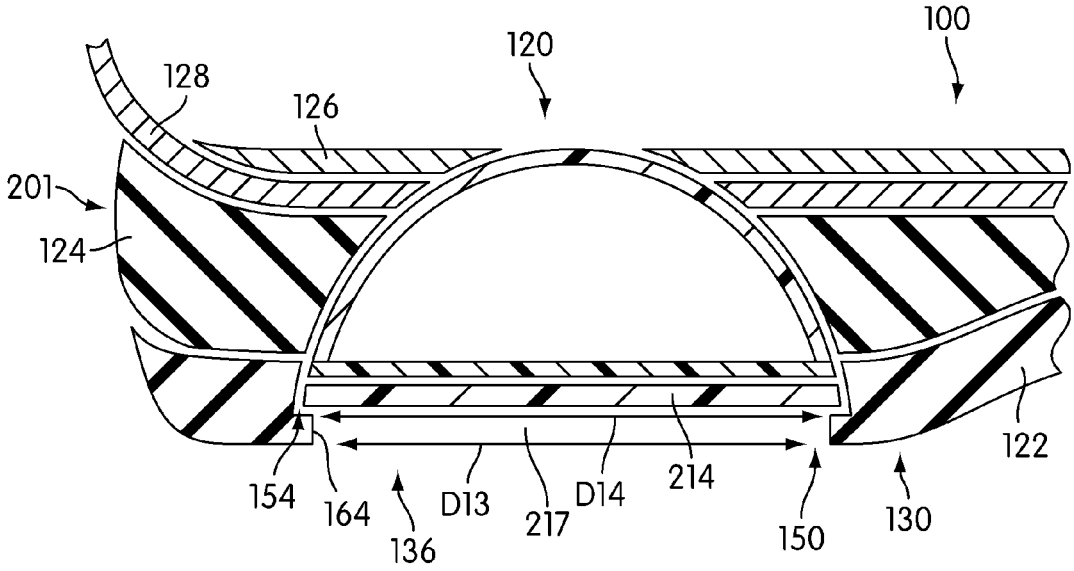
FIG. 14D is a partial cross-sectional view of yet another embodiment of a sole system.

Referring to FIG. 17, air bladder 120 may be positioned within openings 136, 174, 188, and 164 of sole systems 101, 201 by first inserting top 200 of air bladder 120 through bottom surface 130 of outsole layer 122. Air bladder 120 preferably moves into cavity 208, through the openings in the various horizontal layers, in the direction indicated by the arrow in FIG. 17, until the topmost portion 212 of top 200 extends into at least a portion of opening 154 of insole layer 126, as defined by lower peripheral edge 166. Air bladder 120, and in particular top portion 212 of air bladder 120, may assume a variety of positions within cavity 208 and the various horizontal layers. For example, in one of the preferred embodiments, air bladder 120 may be positioned within opening 154 so that topmost portion 212 is slightly beneath the opening in the upper part of insole layer as defined by upper peripheral edge 168 (FIG. 14C). In other preferred embodiments, air bladder 120 may be positioned within opening 154 so that topmost portion 212 is flush with upper peripheral edge 168 (FIGS. 14B and 14C) or, alternatively, topmost portion 212 may protrude through opening 164 of insole layer 126, as defined by upper peripheral edge 168, and extend into void 117 of footwear 100 (FIG. 14A). The amount of topmost portion 212 that is exposed through opening 164 of insole layer 126 may vary according to need. Likewise, diameter D8 of opening 164, along with the other diameters and/or widths of the other layer system openings, may vary according to the shape and dimensions of the air bladder. The aforementioned positioning of air bladder 120 within sole systems 101, 201 similarly applies to those embodiments in which recess 218 is present on topmost portion 212 of the air bladder.

In addition to the various positions of top 200 of air bladder 120 within insole layer 126, base 204 of air bladder 120, which extends into at least a portion of outsole layer 122, may similarly be positioned at various locations within the outsole layer. For example, base 204 may be positioned within opening 136 such that base 204 is contained within an upper part of inner portion 154 so that it is adjacent and in close proximity to midsole layer 124 (FIGS. 13, 14A, 14D) or, alternatively, within a lower part of inner portion 154 so that it is adjacent to outer portion 150 and in close proximity to bottom side 130 of outsole layer 122 (FIGS. 14B-14C). In any of the embodiments, base 204 generally may be secured anywhere within outsole layer 122 and, at the same time, is precluded from moving upwardly within outsole layer 122 or any further into cavity 208. The prevention of upward movement of air bladder 120 within the cavity and horizontal layers of the layer system may be due, in part, to the generally larger diameter of base 204 as compared to the diameter of top 200, as measured at its widest point, of air bladder 120. However, as previously mentioned, there may be other embodiments in which the base is smaller than the top of the air bladder such as may be found in a generally spherical configuration of the air bladder or in some embodiments of the pear-shaped air bladder. However, in these instances, the base of the air bladder may be positioned within outsole layer 122 in a manner similar to the previously described embodiments. Moreover, in any of the aforementioned embodiments, the air bladder is secured within layer systems 121, 221 as the outer arcuate surface 202 of the air bladder coincides, in shape and dimensions, with the inner arcuate curves of the peripheral edges of the horizontal layers and the inner arcuate surface of the midsole cavity (see FIGS. 13, 14A-14D).

Since the peripheral edges and inner arcuate surfaces of the openings, along with the concave cavity of the midsole layer, substantially conform to outer arcuate surface 202 of air bladder 120, air bladder 120 may easily be inserted into cavity 208. Moreover, the shape of inner portion 154 of outsole layer 122 conforms to the shape and dimensions of air bladder base 204 which may further contribute to an easy insertion process. Once air bladder 120 has been inserted into cavity 208, top 200 may be positioned within cavity 208 such that the inner arcuate surfaces of the openings in the various horizontal layers are flush with outer arcuate surface 202 of air bladder 120.

Air bladder 120 may be bonded within sole systems 101, 201 by any suitable means, to at least cavity 208 of midsole layer 124 to secure air bladder 120 within sole systems 101, 201. For example, an adhesive may be applied to inner peripheral surface 184 of midsole cavity 124 so that top 200 of air bladder 120 will adhere to at least the surfaces and edges of the midsole cavity. Top 200 may additionally be bonded to openings in other layers, by similarly applying an adhesive within these openings, for additionally securing air bladder 120 within the sole system.

After air bladder 120 has been inserted within cavity 208, top 200 of air bladder 120 preferably protrudes from opening 164, as defined by upper peripheral edge 168 of insole layer 126, so that a portion of top 200 is exposed. The exposed portion of top 200 allows a user's bare foot 172, and in particular, the user's heel, to be in direct contact with the bladder element. The amount in which top 200 projects up from the upper surface of opening 164 and into the cavity of article of footwear 100 may vary. Top 200 may extend above opening 164 at almost any height, as long as the height of top 200 does not interfere with the placement and/or relative comfort of the foot in article of footwear 100.

Figure 23:
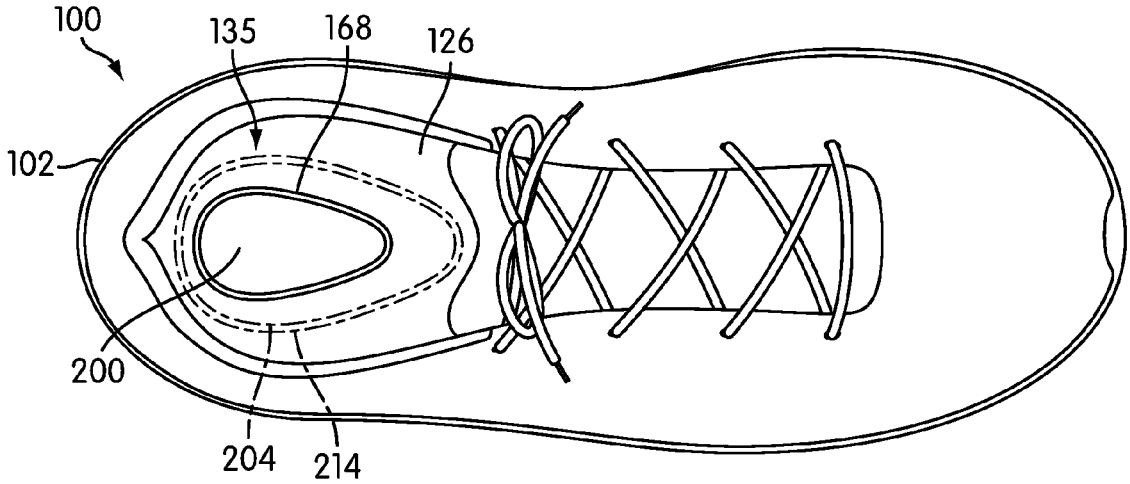
FIG. 23 is a top plan view of another preferred embodiment of an article of footwear, taken along lines B-B of FIG. 22.

In contrast to top 200, base 204 of air bladder 120 is preferably only visually exposed through opening 136 in outsole layer 122. In any of the preferred embodiments, a clear thermoplastic polyurethane (TPU) sheet 214 covers base 204 of air bladder 120 to cover and protect the air bladder from wear and tear. TPU sheet 214 may be disposed in any part of outsole layer 122 and at varying depths. For example, TPU sheet 214 may be positioned in outer portion 150, peripheral recess 156 of middle portion 152, and inner portion 154. Moreover, TPU sheet 214 may be configured in a variety of different geometric shapes, including but not limited to, a rectangle (FIG. 7), a square (FIG. 8), a circle (FIG. 18), or a pear (FIG. 23). Regardless of the shape, TPU sheet 214 is preferably configured so that it at least covers base 204 of air bladder 120. In the embodiments shown in the Figures, TPU sheet 214 not only covers base 204 but further overlaps and is flush with a portion of outsole layer 122. For example, in FIG. 13, TPU sheet 214 covers base 204 but also overlaps and is flush with the upper and lower horizontal surfaces of peripheral recess 156 of middle portion 152. In FIGS. 14A and 14B, TPU sheet 214 covers base 204 but also overlaps and is flush with the upper horizontal surface of outer portion 150. Likewise, in FIG. 14D, TPU sheet 204 covers base 204 but additionally overlaps and is flush with the lower horizontal surface of inner portion 154. In other preferred embodiments, TPU sheet 214 may be sized to substantially correspond to the configuration and dimensions of base 204 so that TPU sheet 214 generally does not extend beyond the periphery of base 204 and overlap onto midsole layer 122 (not depicted in Figures).

TPU sheet 214 may be secured within outsole layer 122 by inserting TPU sheet 214 into outsole layer opening 136. As previously mentioned, TPU sheet 214 may be inserted into any part of the outsole layer and at varying depths, including outer portion 150, peripheral recess 156 in middle portion 152, and inner portion 154. When TPU sheet 214 is positioned within outsole layer 122, peripheral edges 216 of the upper and/or lower surface of TPU sheet 214 may overlap with the part of outsole layer 122 surrounding the periphery of the different portions (150, 152, 154) in the outsole layer. For example, in the embodiments shown in FIGS. 7-8, 18, 23, a dashed line indicates that at least part of peripheral edge 216 of TPU sheet 214 is covered by a portion of outsole layer 122. Alternatively, TPU sheet 214 may be secured within outer portion 150 of outsole layer 122 without any outsole material overlapping its periphery (not depicted in the Figures). In the embodiments in which outsole layer 122 is partially discontinuous (FIGS. 5-6) or completely discontinuous (not depicted in the Figures), only the laterally extending peripheral edges of TPU sheet 214 (between lateral side 103 and medial side 105 of footwear 100) may be covered by the outsole layer.

Figure 9:
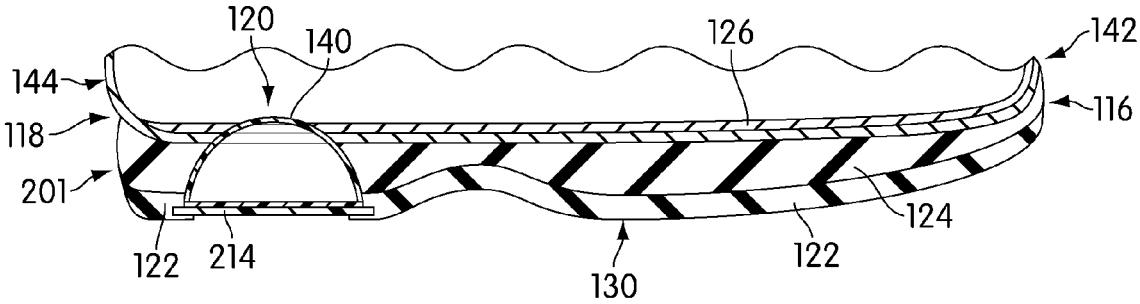
FIG. 9 is a partial cross-sectional view of another preferred embodiment of a sole system.
Figure 19:
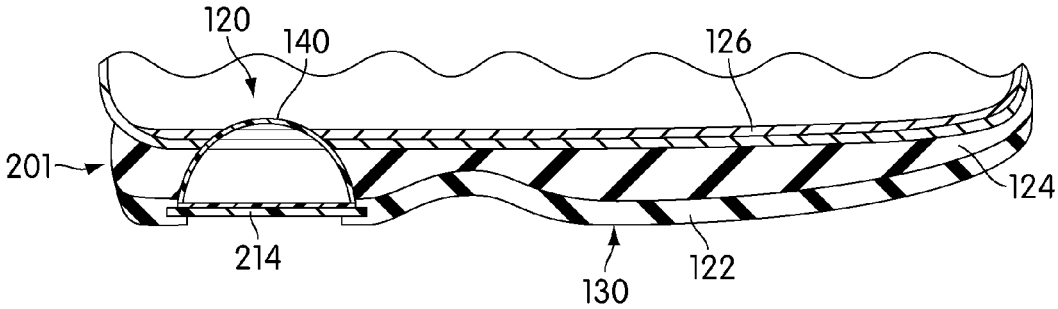
FIG. 19 is a partial cross-sectional view of another preferred embodiment of a sole system.

FIGS. 13 and 14A-14D illustrate some of the possible locations and varying depths of TPU sheet 214 within outsole layer 122 for one air bladder configuration but are similarly applicable to any of the air bladder configurations discussed herein. For example, FIG. 13 shows TPU sheet 214 substantially positioned in peripheral recess 156 of middle portion 152 (FIG. 13). In this configuration, peripheral edges 216 of TPU sheet 214 overlap the inner and/or outer portions of the outsole layer (see also FIG. 19). FIG. 14A shows TPU sheet 214 positioned in the upper part of outer portion 150 adjacent inner portion 154 so that peripheral edge 216 of TPU sheet 214 is flush with the upper horizontal surface of outer portion 150. Moreover, the positioning of TPU sheet 214 in the upper part of outer portion 150 may define an outsole recess 217 beneath the external surface of TPU sheet 214 which extends to bottom side 130 of the outsole layer (see also FIGS. 3-4). FIGS. 14B and 14C also show TPU sheet 214 positioned in outer portion 150 (see also FIG. 9). However, in contrast to the positioning of TPU sheet 214 in FIG. 14A, the outermost surface of TPU sheet 214 is substantially flush with bottom side 130 of the outsole layer. Likewise, FIG. 14D further illustrates the positioning of TPU sheet 214 in inner portion 154 in which the sheet is in close proximity to midsole layer 124. In this instance, the outside recess 217 defined by outer portion 150 is completely open in bottom side 130 of the outsole layer. In those embodiments in which outsole layer 122 is completely discontinuous (not depicted in the Figures), TPU sheet 214 may be positioned substantially adjacent to midsole layer 124. However, as previously discussed, base 204 of air bladder 120 preferably extends into outsole layer 122 such that base 204 is contained within an upper part of inner portion 154. Thus, when outsole layer 122 is discontinuous, TPU sheet 214 preferably covers the bottom of base 204 and any peripheral side portions of base 204 that are exposed in inner portion 154 of outsole layer 122.

Figure 20:
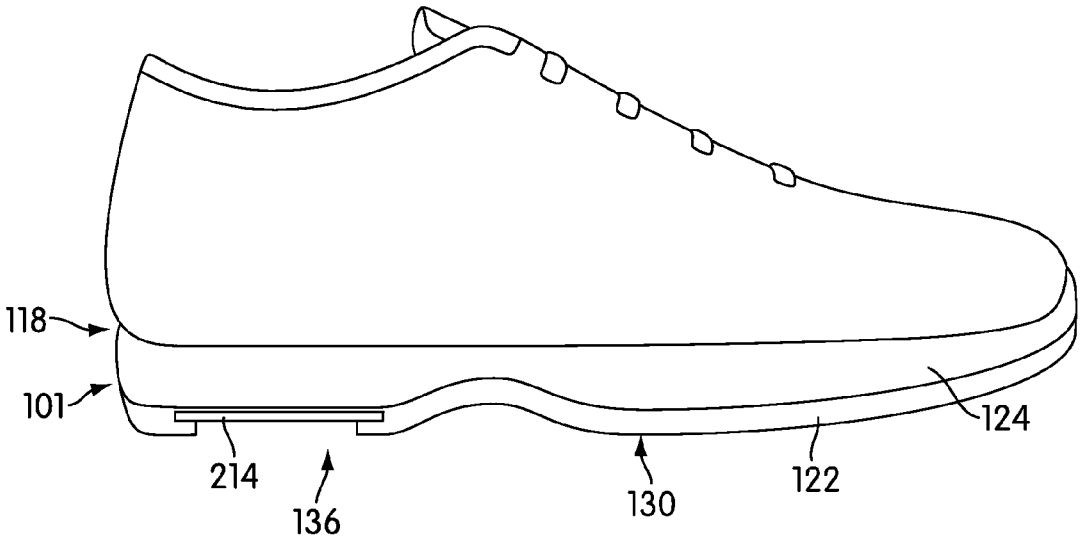
FIG. 20 is a side view of a preferred embodiment of the exterior of a sole system.
Figure 21:
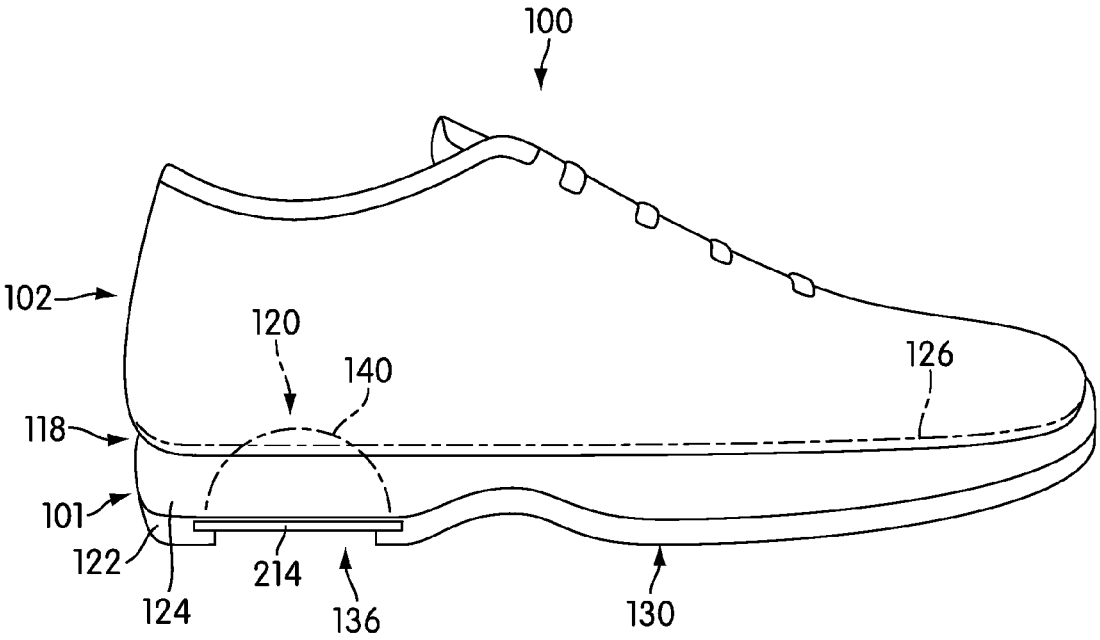
FIG. 21 is a partial schematic view of a preferred embodiment of the exterior of a sole system.

Also, as previously discussed, the various locations and depths of TPU sheet 204 in outsole layer 122 apply to any of the preferred embodiments described above. However, the positions of TPU sheet 214 that are shown in the figures are for illustrative purposes only and do not in any means serve to limit other possible locations of TPU sheet 214 in outsole layer 122. Consequently, TPU sheet 214 may be positioned in substantially any location within outsole 122. FIGS. 20-21 illustrate an article of footwear with a visible TPU sheet 214 as it would appear in one of the preferred embodiments.

TPU sheet 214 may be bonded, by any suitable clear adhesive to air bladder base 214 and/or outsole layer 122 adjacent base 204. The adhesive may also be applied directly onto base 204, as the transparency of the adhesive will not interfere with the visibility of air bladder 120 through bottom surface 130. Moreover, since base 204 is preferably flat, TPU sheet 214 is flush with the base and readily adheres with base 204 and outsole layer 122.

Again, since both TPU sheet 214 and air bladder 120 preferably are made of transparent materials, there is visibility through the entire height of the sole system when air bladder 120 is positioned within the horizontally extending sole layers of the sole system. Moreover, air bladder 120 preferably may be filled with a clear gas which does not interfere with the visibility through the height of the air bladder. The visibility through the entire height of the sole system, in combination with the exposed part of the air bladder above insole layer 126 that directly contacts the user's foot, provides a light appearance and feel to article of footwear 100. Furthermore, replacing part of the sole with air bladder 120 may also provide benefits associated with a lighter article of footwear 100.

While various embodiments of the invention have been described, the description is intended to be exemplary, rather than limiting and it will be apparent to those of ordinary skill in the art that many more embodiments and implementation are possible that are within the scope of the invention. Accordingly, the invention is not to be restricted except in light of the attached claims and their equivalents. Also, various modifications and changes may be made within the scope of the attached claims.

What is claimed is:

1. A sole system for an article of footwear, comprising:

an outsole layer for contacting the surface of the ground, the outsole layer having a predetermined thickness and including an opening extending vertically through the layer;

an insole layer having a predetermined thickness and including an opening extending vertically through the layer;

a midsole layer disposed between the outsole layer and the insole layer, the midsole layer having a predetermined thickness and including a bottom surface and a top surface, the midsole layer further including an opening that extends vertically through the midsole layer and which defines a cavity therein, the cavity opening having a first dimension at the bottom surface which substantially corresponds to the opening in the outsole layer and a second dimension at the top surface which substantially corresponds to the opening in the insole layer; and a bladder element having a top and a base, wherein a portion of the bladder element is secured within the midsole cavity such that the top extends into at least a portion of the opening in the insole layer and the base extends into at least a portion of the opening in the outsole layer, wherein the bladder element and the midsole cavity include corresponding shapes and dimensions.

2. The sole system of claim 1, wherein the first and second dimensions of the midsole cavity opening are defined by a lower and upper peripheral edge, respectively, wherein the opening in the adjacent outsole layer includes an upper peripheral edge and the opening in the adjacent insole layer includes a lower peripheral edge, and wherein the peripheral edges in adjacent layers have substantially the same configuration and dimensions, with the peripheral edges curving inwardly along a vertical axis and being flush with the top of the bladder element.

3. The sole system of claim 2, wherein the outsole layer further includes a lower peripheral edge, with the base of the bladder element extending into the vertical opening in the outsole layer such that the base is substantially flush with the lower peripheral edge of the outsole layer.

4. The sole system of claim 2, wherein the base of the bladder element extends into the vertical opening in the outsole layer such that the base is substantially flush with the upper peripheral edge of the outsole layer.

5. The sole system of claim 2, wherein the outsole layer further includes a lower peripheral edge wherein with the base of the bladder element extends into the vertical opening in the outsole layer such that the base is substantially equidistant from the lower and upper peripheral edges of the outsole layer.

6. The sole system of claim 2, wherein the peripheral edges are inwardly curved along a horizontal axis and include substantially the same configuration and dimensions in adjacent layers.

7. The sole system of claim 2, wherein the midsole cavity includes an inner arcuate surface that is concave, while the top of the bladder element includes an outer arcuate surface that is convex, and wherein the inner and outer arcuate surfaces are flush and have substantially the same shape and dimensions.

8. The sole system of claim 2, wherein the layers are horizontal such that each includes a longitudinal axis that is aligned with the length of the shoe, the horizontal layers having substantially corresponding surfaces and being disposed on each other in a vertically stacked configuration, and wherein the vertical openings and peripheral edges in adjacent layers are aligned with one another and substantially conform to and are flush with an arcuate portion of the bladder element.

9. The sole system of claim 2, wherein the insole layer further includes an upper peripheral edge through which the top of the bladder element protrudes from and extends beyond so that a user's bare foot is in direct contact with the top of the bladder element.

10. The sole system of claim 2, wherein the opening in the insole layer further includes an upper peripheral edge with which the top of the bladder element is flush so that a user's bare foot is in direct contact with the top of the bladder element.

11. The sole system of claim 2, wherein the opening in the insole layer further includes an upper peripheral edge, and wherein the bladder element is positioned in the insole layer opening such that the top of the bladder element is slightly below the upper peripheral edge of the insole layer so that a user's bare foot is in direct contact with the top of the bladder element.

12. The sole system of claim 1, wherein the first dimension of the cavity opening is greater than the second dimension of the cavity opening.

13. The sole system of claim 1, wherein the base includes a clear thermoplastic polyurethane sheet that covers the base while still providing visibility of the bladder element.

14. The sole system of claim 13, wherein the thermoplastic polyurethane sheet is at least the size of the base.

15. The sole system of claim 1 further comprising a strobel layer disposed between the midsole layer and the insole layer, the strobel layer having a predetermined thickness and including an opening extending vertically through the layer, wherein the top of the bladder element extends through the strobel layer opening and into the insole layer.

16. The sole system of claim 15, wherein the vertical opening in the strobel layer includes a lower peripheral edge and an upper peripheral edge, and wherein the upper peripheral edge substantially corresponds to the lower peripheral edge on the insole layer and the lower peripheral edge on the strobel layer substantially corresponds to the upper peripheral edge of the cavity opening in the midsole layer, with the peripheral edges being curved inwardly along a vertical axis and having substantially the same shape and dimensions in adjacent layers.

17. The sole system of claim 16, wherein the strobel layer is horizontal and includes a longitudinal axis that is aligned with the length of the shoe, and wherein the horizontal strobel layer substantially corresponds to the other layers and is disposed with the other layers in a vertically stacked configuration, and wherein the vertical openings and peripheral edges in adjacent layers are aligned with one another and substantially conform to and are flush with an arcuate portion of the bladder element.

18. The sole system of claim 17, wherein the peripheral edges of the strobel layer and adjacent layers are inwardly curved along a horizontal axis and include substantially the same configuration and dimensions.

19. The sole system of claim 1, wherein the bladder element is pear-shaped with a convex top and a flat base.

20. The sole system of claim 19, wherein the pear-shaped bladder element includes a recess in the top which substantially corresponds to a contoured surface of a user's heel.

21. The sole system of claim 20, wherein the recess is substantially pear-shaped.

22. The sole system of claim 1, wherein the top of bladder element is dome-shaped and the base is flat.

23. The sole system of claim 22, wherein the dome shape is an oblate ellipsoid.

24. The sole system of claim 22, wherein the dome shape is a hemisphere.

25. The sole system of claim 22, wherein the dome-shaped bladder element includes a recess in the top which substantially corresponds to a contoured surface of a user's heel.

26. The sole system of claim 25, wherein the recess is substantially circular.

27. The sole system of claim 1, wherein the bladder element is made of a transparent material so that there is visibility through the entire bladder element.

28. The sole system of claim 1, wherein the bladder element is bonded to the midsole cavity.

29. The sole system of claim 1, wherein the outsole is partially discontinuous.

30. The sole system of claim 1 wherein the bladder element is filled with air.

31. A sole system for an article of footwear comprising:

an outsole layer for contacting the surface of the ground, the outsole layer having a predetermined thickness and including an opening extending vertically through the layer;

an insole layer having a predetermined thickness and including an opening extending vertically through the layer;

a midsole layer disposed between the outsole layer and the insole layer, the midsole layer having a predetermined thickness and including a bottom surface and a top surface, the midsole layer further including an opening that extends vertically through the midsole layer and which defines a cavity therein, the cavity opening having a first dimension at the bottom surface which substantially corresponds to the opening in the outsole layer and a second dimension at the top surface which substantially corresponds to the opening in the insole layer;

a bladder element having a top and a base, wherein a portion of the bladder element is secured within the midsole cavity such that the top extends into at least a portion of the opening in the insole layer and the base extends into at least a portion of the opening in the outsole layer, wherein the bladder element and the midsole cavity include corresponding shapes and dimensions;

wherein the first and second dimensions of the midsole cavity opening are defined by a lower and upper peripheral edge, respectively, with the opening in the adjacent outsole layer including an upper peripheral edge and the opening in the adjacent insole layer including a lower peripheral edge;

wherein the peripheral edges in adjacent layers have substantially the same configuration and dimensions, with the peripheral edges curving inwardly along a vertical axis and a horizontal axis and being flush with the top of the bladder element;

wherein the layers are horizontal such that each includes a longitudinal axis that is aligned with the length of the shoe, the horizontal layers having substantially corresponding surfaces and being disposed on each other in a vertically stacked configuration, and wherein the vertical openings and peripheral edges in adjacent layers are aligned with one another and substantially conform to and are flush with an arcuate portion of the bladder element.

32. The sole system of claim 31, wherein the midsole cavity includes an inner arcuate surface that is concave, while the top of the bladder element includes an outer arcuate surface that is convex, and wherein the inner and outer arcuate surfaces are flush and have substantially the same shape and dimensions.

33. The sole system of claim 31, wherein the insole layer further includes an upper peripheral edge through which the top of the bladder element protrudes from and extends beyond so that a user's bare foot is in direct contact with the top of the bladder element.

34. The sole system of claim 31, wherein the outsole layer further includes a lower peripheral edge, with the base of the bladder element extending into the vertical opening in the outsole layer such that the base is substantially flush with the lower peripheral edge of the outsole layer.

35. The sole system of claim 34, wherein the base includes a clear thermoplastic polyurethane sheet that covers the base while still providing visibility of the bladder element.

36. The sole system of claim 31 further comprising a strobel layer disposed between the midsole layer and the insole layer, the strobel layer having a predetermined thickness and including an opening extending vertically through the layer, wherein the top of the bladder element extends through the strobel layer opening and into the insole layer.

37. The sole system of article of claim 36, wherein the strobel layer is horizontal and includes a longitudinal axis that is aligned with the length of the shoe, wherein the horizontal strobel layer substantially corresponds to the other layers and is disposed with the other layers in a vertically stacked configuration, and wherein the vertical openings and peripheral edges in adjacent layers are aligned with one another and substantially conform to and are flush with an arcuate portion of the bladder element.

38. The sole system of claim 31, wherein the top of bladder element is convex and the base is flat.

39. A sole system for an article of footwear comprising:

an outsole layer for contacting the surface of the ground, the outsole layer having a predetermined thickness and including an opening that extends vertically through the layer and which is defined by a lower and upper peripheral edge;

an insole layer having a predetermined thickness and including an opening that extends vertically through the layer and which is defined by a lower and upper peripheral edge;

a midsole layer disposed between the outsole layer and the insole layer, the midsole layer having a predetermined thickness and including an opening that extends vertically through the midsole layer and which defines a cavity therein, the cavity having an inner arcuate surface that is concave, with the cavity opening being defined by a first peripheral edge and a second peripheral edge, wherein the peripheral edges in adjacent layers have substantially the same configuration and dimensions;

a bladder element having a convex top with an outer arcuate surface and a flat base, wherein a portion of the outer arcuate surface is secured within the midsole cavity such that the convex top extends into at least a portion of the vertical opening in the insole layer and the flat base extends into at least a portion of the vertical opening in the outsole layer, wherein the outer arcuate surface of the bladder element is flush with and has substantially the same shape and dimensions as the inner arcuate surface of the midsole cavity;

a clear sheet that is positioned within the opening in the outsole layer and which covers a portion of the base while still providing visibility of the bladder element;

wherein the layers are horizontal such that each includes a longitudinal axis that is aligned with the length of the shoe, the horizontal layers having substantially corresponding surfaces and being disposed on one another in a vertically stacked configuration such that the vertical openings in adjacent layers are aligned with one another;

wherein the peripheral edges in adjacent layers have substantially the same configuration and dimensions, and wherein the peripheral edges curve inwardly along a vertical axis and a horizontal axis and are flush with the outer arcuate surface of the bladder element.

40. The sole system of claim 39 further comprising a strobel layer disposed between the midsole layer and the insole layer, the strobel layer having a predetermined thickness and including an opening extending vertically through the layer, wherein the top of the bladder element extends through the strobel layer opening and into the insole layer, wherein the vertical opening in the strobel layer includes a lower peripheral edge and an upper peripheral edge, and wherein the upper peripheral edge substantially corresponds to the lower peripheral edge on the insole layer and the lower peripheral edge on the strobel layer substantially corresponds to the upper peripheral edge of the cavity opening in the midsole layer, with the peripheral edges being curved inwardly along a vertical axis and having substantially the same shape and dimensions in adjacent layers.

41. The sole system of claim 40, wherein the strobel layer is horizontal and includes a longitudinal axis that is aligned with the length of the shoe, and wherein the horizontal strobel layer substantially corresponds to the other layers and is disposed with the other layers in a vertically stacked configuration, and wherein the vertical openings and peripheral edges in adjacent layers are aligned with one another and substantially conform to and are flush with an arcuate portion of the bladder element, and wherein the peripheral edges of the strobel layer and adjacent layers are inwardly curved along a horizontal axis and include substantially the same configuration and dimensions.

* * * * *